US008474936B2

(12) United States Patent
Takekoshi et al.

(10) Patent No.: US 8,474,936 B2
(45) Date of Patent: Jul. 2, 2013

(54) INK JET PRINTING APPARATUS, INK JET PRINTING METHOD, AND DATA GENERATING APPARATUS

(75) Inventors: Rie Takekoshi, Kawasaki (JP); Takao Ogata, Tokyo (JP); Takumi Kaneko, Tokyo (JP); Noboru Kunimine, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/365,651

(22) Filed: Feb. 3, 2012

(65) Prior Publication Data

US 2012/0133691 A1 May 31, 2012

Related U.S. Application Data

(62) Division of application No. 12/209,869, filed on Sep. 12, 2008, now Pat. No. 8,132,878.

(30) Foreign Application Priority Data

Sep. 19, 2007 (JP) ..... 2007-242664

(51) Int. Cl.
*B41J 29/38* (2006.01)

(52) U.S. Cl.
USPC ..... 347/12; 347/98; 347/100

(58) Field of Classification Search
USPC ..... 347/5, 9, 12, 15, 98–99, 100
See application file for complete search history.

(56) References Cited

U.S. PATENT DOCUMENTS

| | | | |
|---|---|---|---|
| 5,864,350 | A | 1/1999 | Shioya et al. |
| 6,267,476 | B1 | 7/2001 | Kato et al. |
| 7,682,013 | B2 | 3/2010 | Hoshino |
| 8,083,337 | B2 | 12/2011 | Takekoshi et al. |
| 2003/0202026 | A1 | 10/2003 | Smith et al. |
| 2006/0227194 | A1 | 10/2006 | Hoshino |
| 2009/0073204 | A1 | 3/2009 | Takekoshi et al. |

FOREIGN PATENT DOCUMENTS

| | | | |
|---|---|---|---|
| JP | 8-216432 | A | 8/1996 |
| JP | 2000-015789 | A | 1/2000 |
| JP | 2000-153677 | A | 6/2000 |
| JP | 2003-170650 | A | 6/2003 |
| JP | 2004-122496 | A | 4/2004 |
| JP | 2004-188658 | A | 7/2004 |
| JP | 2005-035042 | A | 2/2005 |
| JP | 2005-81754 | A | 3/2005 |
| JP | 2006-088529 | A | 4/2006 |
| JP | 2006-289722 | A | 10/2006 |

*Primary Examiner* — Lam S Nguyen
(74) *Attorney, Agent, or Firm* — Fitzpatrick, Cella, Harper & Scinto

(57) ABSTRACT

An ink jet printing apparatus, an ink jet printing method, and a data generating apparatus are provided in which an image performance such as an abrasion resistance can be improved and a printing head can have a longer life by ejecting processing liquid at an appropriate time. The processing liquid is ejected, to a predetermined area on a printing medium in which the formation of a image by ink is completed, from a printing head in two or more scannings in five scannings of the printing heads.

14 Claims, 20 Drawing Sheets

PROCESSING LIQUID EJECTION PATTERN

EJECTION DATA (C, M)

| | | | | |
|---|---|---|---|---|
| C | C M | C | M | |
| C | C M | M | | |
| C | M | M | | |
| M | | | C | |
| | | | | |

DATA C

FIRST SCANNING

SECOND SCANNING

THIRD SCANNING

FOURTH SCANNING

DATA M

FIRST SCANNING

SECOND SCANNING

THIRD SCANNING

FOURTH SCANNING (C+M) DATA

FIRST SCANNING

| | | | | |
|---|---|---|---|---|
| C | | | | |
| | M | | | |
| | | M | | |
| | | | C | |
| | | | | |

FIG.10A

SECOND SCANNING

| | | | | |
|---|---|---|---|---|
| | | C | | |
| C | | | | |
| | M | | | |
| | | | | |
| | | | | |

FIG.10B

THIRD SCANNING

| | | | | |
|---|---|---|---|---|
| | M | | M | |
| | C | | | |
| | | M | | |
| | | | | |
| | | | | |

FIG.10C

FOURTH SCANNING

| | | | | |
|---|---|---|---|---|
| | C | | | |
| | | M | | |
| C | | | | |
| M | | | | |
| | | | | |

FIG.10D

SCANNING NUMBER AT COMPLETION OF IMAGE FORMATION

| | | | | |
|---|---|---|---|---|
| 1 | 4 | 2 | 3 | |
| 2 | 3 | 4 | | |
| 4 | 2 | 3 | | |
| 4 | | | 1 | |
| | | | | |

FIG.11

| | | | | |
|---|---|---|---|---|
| 2 | 5 | 3 | 4 | |
| 3 | 4 | 5 | 1 | |
| 5 | 3 | 4 | 1 | |
| 5 | 1 | 1 | 2 | |
| | | | | |

FIG.12

| | | | | |
|---|---|---|---|---|
| 2 | 5 | | 4 | |
| | 4 | 5 | 1 | |
| 5 | 3 | 4 | | |
| 5 | | 1 | 2 | |
| | | | | |

FIG.13

PROCESSING LIQUID EJECTION DATA

FIRST SCANNING

SECOND SCANNING

THIRD SCANNING

FOURTH SCANNING

FIFTH SCANNING

RANDOM MASK C

FIRST SCANNING

SECOND SCANNING

THIRD SCANNING

FOURTH SCANNING

RANDOM MASK M

FIRST SCANNING

SECOND SCANNING

THIRD SCANNING

FOURTH SCANNING

RANDOM MASK (C+M)
FOR FOURTH SCANNING

RANDOM MASK

FIFTH SCANNING

FOURTH SCANNING

PROCESSING LIQUID EJECTION DATA

FIRST SCANNING

| | | | | |
|---|---|---|---|---|
| | | | | |
| | | | | |
| | | | | |
| | | | | |
| | | | | |

FIG.20A

SECOND SCANNING

| | | | | |
|---|---|---|---|---|
| | | | | |
| | | | | |
| | | | | |
| | | | | |
| | | | | |

FIG.20B

THIRD SCANNING

| | | | | |
|---|---|---|---|---|
| | | | | |
| | | | | |
| | | | | |
| | | | | |
| | | | | |

FIG.20C

FOURTH SCANNING

| | | | | |
|---|---|---|---|---|
| H | | | H | |
| | H | | | |
| | H | H | | |
| | | | | |
| | | | | |

FIG.20D

FIFTH SCANNING

| | | | | |
|---|---|---|---|---|
| | H | | | |
| | | H | H | |
| H | | | | |
| H | | H | H | |
| | | | | |

FIG.20E

INK JET PRINTING APPARATUS, INK JET PRINTING METHOD, AND DATA GENERATING APPARATUS

The present application is a divisional of U.S. patent application Ser. No. 12/209,869 filed Sep. 12, 2008, the entire disclosure of which is incorporated by reference herein.

BACKGROUND OF THE INVENTION

1. Field of the Invention

The present invention relates to an ink jet printing apparatus, an ink jet printing method, and a data generating apparatus by which a printing head capable of ejecting an ink and a processing liquid can scan a predetermined area of a printing medium a plurality of times to form an image by ejecting the ink onto the printing medium and to cover the formed image with the processing liquid.

2. Description of the Related Art

In recent years, ink jet printing apparatus has been widely used to provide printed images having higher definition, for public display applications and commercial display applications such as photographs, posters, and graphic prints. In the case of images formed for public display applications and commercial display applications, a requirement for high definition as well as a requirement for improving the image quality (e.g., uniform glossiness, bronze characteristic) and a requirement for improving the image toughness providing the strength and the long-term storage stability of the image. The bronze characteristic refers to a degree at which a color different from that of illumination light is reflected due to the bronze phenomenon when illumination light has mirror reflection (specular reflection) at an image surface. The bronze characteristic is known as being remarkable in a cyan ink in particular.

Ink coloring used in an ink jet printing apparatus is mainly classified as either a dye-base ink or a pigment-base ink. Dye ink includes coloring dye dissolved in water or alcohol medium in a molecular state and thus has a characteristic that dye ink is more transparent than pigment ink and provides superior color production. However, dye ink is disadvantageous in that early discoloring is caused due to ultraviolet light or an active gas in the atmosphere. On the other hand, pigment ink has a superior discoloring resistance in its long-term storage. In recent years, advanced manufacturing techniques have allowed pigment ink to establish both long-term storage stability (unique to pigment ink) and superior color production equal to that of dye ink. Thus, more ink jet printing apparatuses use pigment ink mainly for demanding commercial printing applications such as photographs and posters where a printed image must be stored for a long term.

However, an application using pigment as described above in particular still has the conventional image quality-related problems such as where the glossiness of images tends to be unequal and where the bronze phenomenon occurs as typical in pigment cyan ink. Another problem is that an increased number of display applications such as posters show a weaker image toughness and a poorer long-term storage stability compared to an offset-printed image, for example.

The following section will exemplarily describe the problem of abrasion resistance among the image toughness-related problems. The main problem is that an image printed on a glossy paper using pigment ink is easily damaged, even in general handling operation such as the subsequent handling and display.

FIG. 22A is a schematic view illustrating a cross section of an image formed by using a pigment ink on a printing medium having thereon an ink absorbing layer. The following section will described the reason why the image formed on a glossy paper by the pigment ink is easily damaged with reference to FIG. 22A.

A printing medium used for an ink jet printing apparatus is structured so that the surface of a base member (not shown) such as a paper or a film has thereon an ink absorbing layer 24 for the purpose of absorbing an ink. In order to reduce the oozing of the ink for example, the ink absorbing layer 24 includes a great amount of inorganic fine particles (of silica or alumina, for example) that are highly-absorptive to ink solvent. A printing medium used for the printing of a photograph such as glossy paper must have a flat and smooth surface, and thus generally uses inorganic particles having a dimension of the order of less than a micrometer. Thus, the gap between inorganic fine particles formed in the ink absorbing layer 24 is proportional to the particles diameter and thus is formed by fine pores having a dimension of the order of less than a micrometer.

On the other hand, coloring pigment particles having a dimension of about 100 nanometers are dispersed in pigment ink. This prevents the coloring pigment particles from entering the ink absorbing layer 24, when the coloring pigment particles have a diameter larger than that of the fine pores of the ink absorbing layer 24. In this case, the coloring pigment particles remain on the surface of the ink absorbing layer 24 as if they are blocked by a filter. In the case of a printing medium such as glossy paper, the coloring pigment particles generally have a diameter larger than that of the fine pores of the ink absorbing layer 24. Thus, a pigment ink layer 25 is formed on the surface of the ink absorbing layer 24.

Due to the pigment ink layer 25 formed on the surface of the ink absorbing layer 24 as described above, the image surface is easily damaged when an external force is applied to the pigment ink layer 25. In some cases, the pigment ink layer 25 (image) may be peeled due to an external force. For this reason, images formed using pigment ink have frequently been considered to have abrasion resistance-related problems.

Japanese Patent Laid-Open No. 2000-153677 discloses a laminate film method to protect an image formed by a pigment ink by covering the printed face of the image by a cover film. Japanese Patent Laid-Open No. 2005-81754 discloses a liquid laminate method to cover the printed face of the image using transparent resin liquid. Japanese Patent Laid-Open No. 2003-170650 discloses a post-processing method to mix thermoplastic resin particles in the ink absorbing layer of a printing medium for pigment ink to subsequently heat the printing medium to adhere a pigment ink layer to the ink absorbing layer.

In the case of the laminate film method, the abrasion resistance-related problem can be solved by covering the image surface with a resin film having a high film strength. However, the image surface covered by the film deteriorates the original texture of the printing medium such as paper. The laminate processing also increases cost, because another apparatus different from a printing apparatus is required.

The liquid laminate method can carry out, just after the printing of the image, the liquid laminate processing in the same printing apparatus. However, in order to obtain a sufficient effect on the abrasion resistance, a film thickness of a few microns must be formed. As in the laminate film method, the original texture of the printing medium therefore deteriorates. As disclosed in Japanese Patent Laid-Open No. 2005-81754, a further higher abrasion resistance is practically required when a thin film having a thickness equal to or lower than 1 micron is formed.

In the case of the post-processing method, the types of printing media for which an improved abrasion resistance can be expected are limited, and a heating processing step is required, causing the apparatus to have a larger size.

The problem of the abrasion resistance as described above can be very effectively solved by forming a transparent layer on the top layer of the pigment ink layer 25 on glossy paper to reduce the dynamic friction coefficient of the image surface. In recent years a configuration has been suggested for an ink jet printing apparatus to use a glossy paper including a transparent layer formed by a processing liquid including resin having an abrasion resistance function to print an image.

FIG. 22B is a schematic view illustrating a cross section of an image having a transparent layer formed on it by a processing liquid. A transparent layer 26 of the processing liquid is formed on the outermost surface so as to cover the pigment ink layer 25. The transparent layer 26 prevents the image surface of the pigment ink layer from being peeled or damaged by an external force (e.g., contact with a nail), thus providing the image with an improved abrasion resistance.

Japanese Patent Laid-Open No. H8-216432 discloses a general method to apply the processing liquid as described above. In the general method, in order to improve the water resistance of an image formed by an anionic dye ink, a processing liquid including cationic substance is applied after the application of the anionic dye ink. This method uses a multi-path printing apparatus to apply the ink to a printing medium through a plurality of scannings to print an image. At the final printing in the plurality of printing scannings (final printing scanning), the processing liquid is ejected to a position at which the ink was ejected, based on the ejection data for the processing liquid.

Covering the outermost surface of a printed ink image on a printing medium with a transparent layer is very effective to improve an image performance such as abrasion resistance. However, in order to apply the processing liquid to the entire surface of an image printed by pigment inks of a plurality of colors, a relatively large amount of processing liquid is required as compared to the amount of each color of the pigment ink. This has caused problems such as requiring a large size ink tank for the processing liquid and an increased running cost due to an increased consumption of the processing liquid, for example.

When the processing liquid is applied only in the final printing scan as disclosed in Japanese Patent Laid-Open No. H8-216432, the processing liquid is applied through a single scanning. This creates a case where the processing liquid may be applied in an amount exceeding the limited total amount of the liquid that can be absorbed by the printing medium at one time. In this case, the excessive liquid may cause problems in the image performance, such as a flooded ink phenomenon, bleeding, beading, defective drying, and a interference pattern phenomenon due to the transparent layer finished to have a mirror surface. When the multi-path printing apparatus is structured so that the processing liquid is ejected through ejection openings of a printing head only in the final printing scan, ejection openings for ejecting the processing liquid are concentrated within a specific area, thus causing a risk of a lack of durability of the printing head. When a printing head for ejecting ink is used as the printing head for ejecting the processing liquid, only a part of a plurality of ejection openings existing in the printing head for ejecting the processing liquid is used to eject the processing liquid and the other ejection openings are not used, wasting ejection openings.

SUMMARY OF THE INVENTION

The present invention provides an ink jet printing apparatus, an ink jet printing method, and a data generating apparatus by which a processing liquid can be ejected at an appropriate timing to improve an image performance such as abrasion resistance and to provide the printing head with a longer life.

The present invention in its first aspect provides an ink jet printing apparatus as specified in the claims.

The present invention in its second aspect provides an ink jet printing method as specified in the claims.

The present invention in its third aspect provides a data generating apparatus.

According to the present invention, a processing liquid is ejected by a plurality of scannings of a printing head to a predetermined region already subjected to an image formation by an ink. Thus, ejection of the processing liquid can be carried out during two or more scannings. As a result, drying of the processing liquid ejected to the printing medium can be promoted while improving the image performance of the image (e.g., abrasion resistance) to prevent flooded ink, thus achieving the printing of a high-quality image. Furthermore, ejection timings of the processing liquid carried out at two or more scannings can expand an area of the printing head used to eject the processing liquid, thus improving the durability of the printing head.

Further features of the present invention will become apparent from the following description of exemplary embodiments with reference to the attached drawings.

BRIEF DESCRIPTION OF THE DRAWINGS

FIG. 10A to FIG. 10D illustrate the ejection data for cyan ink and magenta ink in the first scanning to the fourth scanning in FIG. 5, respectively;

FIG. 11 illustrates scanning numbers at the completion of the image formation corresponding to the ejection data of FIG. 10A to FIG. 10D;

FIG. 12 illustrates the data obtained by adding "1" to the values of FIG. 11;

FIG. 13 illustrates the data obtained by calculating the logical sum of the ejection pattern of FIG. 6 and the data of FIG. 12;

FIG. 20A to FIG. 20E illustrate ejection data for the processing liquid in the first scanning to the fifth scanning in FIG. 15, respectively;

DESCRIPTION OF THE EMBODIMENTS

In this specification, the term "processing liquid" means a liquid that is put into contact with an ink to improve the image performance, such as the image toughness or image quality. The expression "improve the image performance" as used herein means to improve at least one of the abrasion resistance, the weather resistance, the water resistance, and the alkali resistance to improve the toughness of an image formed by the ink. On the other hand, the expression "to improve the image quality" means to improve at least one of the glossiness, the haze characteristic, and the bronze characteristic to improve the optical quality of an image formed by the ink. In this embodiment, a processing liquid that improves the abrasion resistance will be described as an example.

The following section will describe preferred embodiments of the present invention with reference to the drawings.

(First Embodiment)

FIG. 1 to FIG. 14E illustrate the first embodiment of the present invention. The following section will describe the first embodiment by explaining the entire configuration, composition of ink and processing liquid, printing operation, configuration example of image processing system, and method for generating ejection data for processing liquid.

(Entire Configuration)

Figure 1:
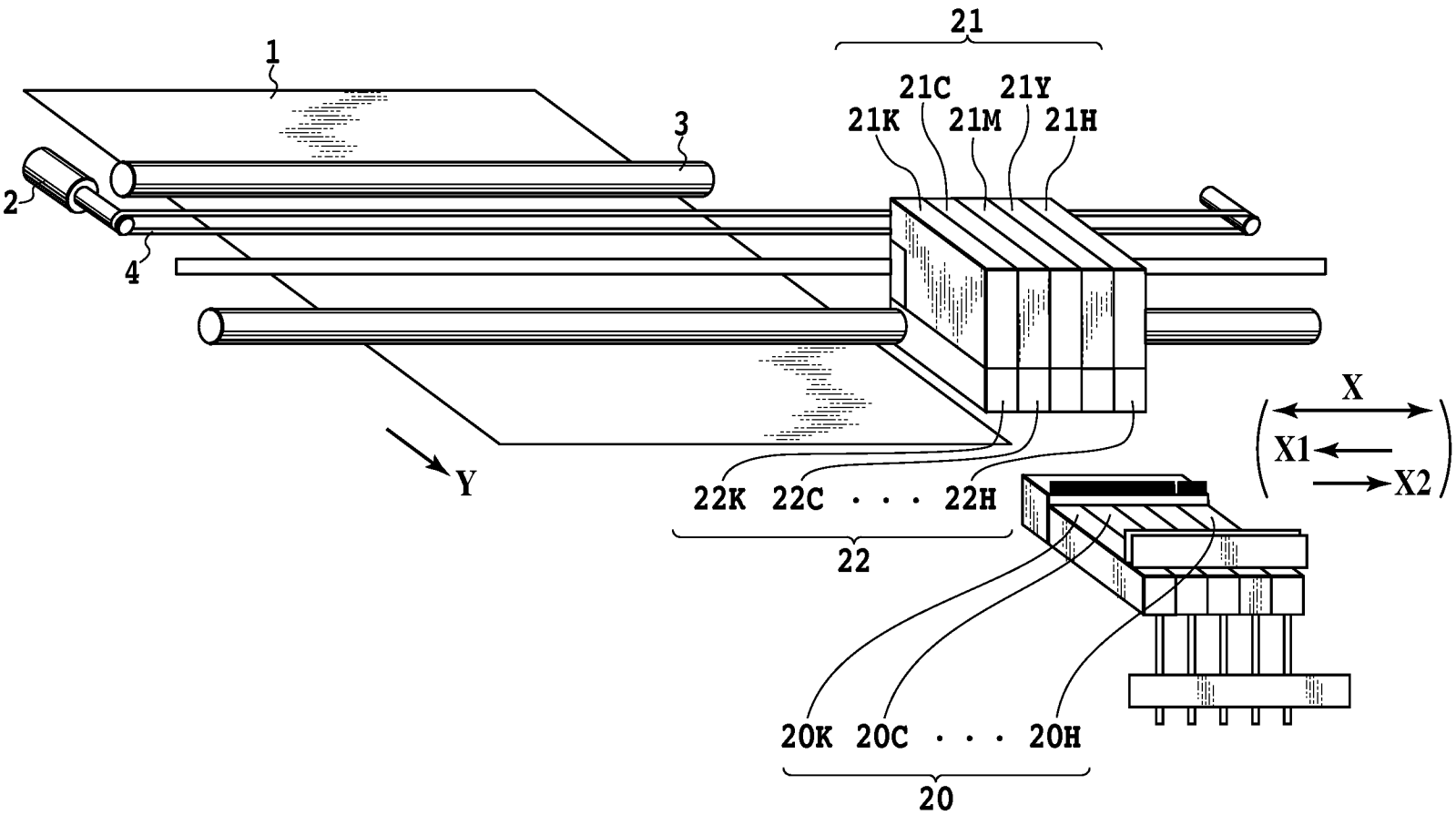
FIG. 1 is a perspective view illustrating the main part of an ink jet printing apparatus of a first embodiment of the present invention.

FIG. 1 is a perspective view illustrating a main part of an ink jet printing apparatus of this embodiment. A printing head 22 has a plurality of printing heads for color pigment inks and for a processing liquid. These printing heads include ejection openings through which the color pigment ink and the processing liquid are ejected to a printing medium 1 to carry out a printing operation. The printing head 22 has five printing heads 22K, 22C, 22M, 22Y, and 22H through which color pigment inks of black (K), cyan (C), magenta (M), and yellow (Y) and a processing liquid (H) are ejected, respectively. An ink tank 21 has five ink tanks 21K, 21C, 21M, 21Y, and 21H for storing the inks of the correct colors and the processing liquid to be supplied to the respective printing heads 22K, 22C, 22M, 22Y, and 22H. The printing head 22 and the ink tank 21 can be moved in the main scanning direction (direction shown by the arrow X).

A cap unit 20 includes five caps 20K, 20C, 20M, 20Y and 20H for capping ink ejection faces of the respective printing heads. When a printing operation is not performed, the printing head 22 and the ink tank 21 are returned to a home position where the cap 20 is provided and wait until a predetermined time passes. When the predetermined time has passed, the printing head 22 is capped in order to prevent the ink ejection face of the printing head 22 (face including the ejection openings) from drying.

It is noted that, when each of these printing head or the ink tanks is individually described, the reference numeral given to the component is used. However, when these components are described collectively, the printing head is denoted with a generic reference numeral 22, the ink tank is denoted with a generic reference numeral 21, and the cap is denoted with a generic reference numeral 20.

In this example, the printing heads and the ink tanks constitute, in an integral or separate manner, a head cartridge. The head cartridge is detachably mounted on a carriage (not shown). The printing heads and the ink tanks also may be separately provided on the carriage without constituting the head cartridge.

The carriage is guided so as to be movable along the main scanning direction shown by the arrow X and caused by a carriage motor 2 to reciprocate via a belt 4 in the main scanning direction. The printing medium 1 is transported by a transportation roller in the sub-scanning direction (direction shown by the arrow Y) crossing (in this example, orthogonal to) the main scanning direction.

Figure 2:
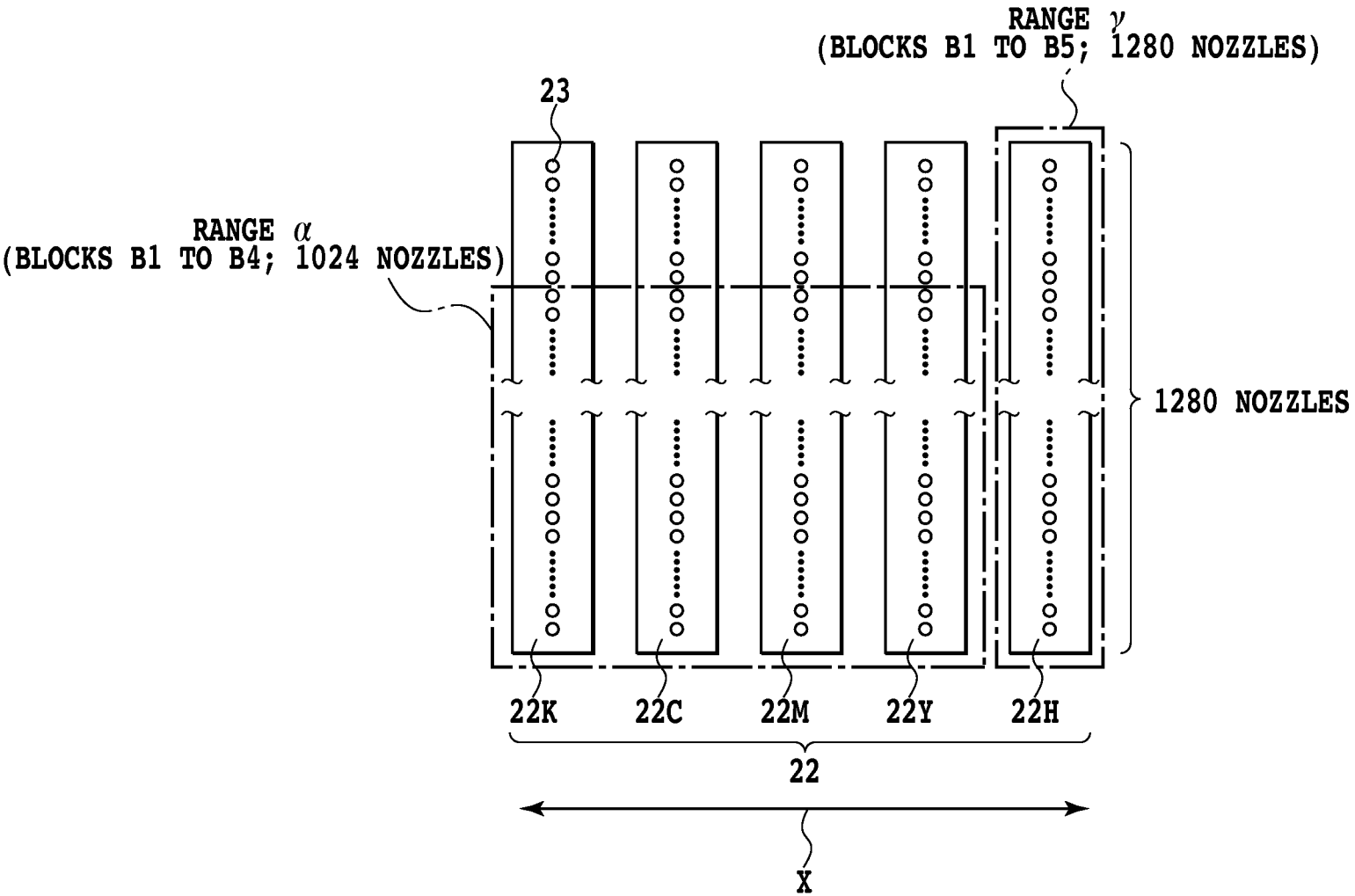
FIG. 2 illustrates a printing head used in the first embodiment seen from the ejection opening side.

FIG. 2 illustrates the printing head 22 seen from the ejection opening side. The printing heads 20K, 20C, 20M, 20Y, and 20H of this example include 1280 ejection openings 23 forming nozzles that are arranged with a density of 1200 dpi in the sub-scanning direction (direction shown by the arrow Y) crossing (in this example, orthogonal to) the main scanning direction. Each of ejection openings 23 ejects the inks at one time in an amount of about 4 ng. In this embodiment, the printing heads for ejecting the pigment ink and the printing head for ejecting the processing liquid have the same configuration.

(Compositions of Ink and Processing Liquid)

Next, compositions of the pigment ink and the processing liquid used in this embodiment will be described.

(Yellow Ink)

(1) Preparation of Dispersion Liquid

First, an aqueous solution of styrene/ butylacrylate/acrylic acid copolymer ((copolymer ratio (weight ratio)=30/40/30), acid value of 202, weight-average molecular weight of 6500, and solid content of 10%) was neutralized by potassium hydroxide. The above polymer aqueous solution of 30 parts, pigment [C.I. pigment yellow 74 (product name: Hansa Brilliant Yellow 5GX (made by Clariant Co.))] of 10 parts, and ion-exchanged water of 60 parts were mixed and were mechanically agitated. Next, the above material was placed in a batch-type vertical sand mill (made by Aimex Co.) to fill zirconia beads having a diameter of 0.3 mm of 150 parts to the sand mill. Then, the material was subjected to a dispersion processing for 12 hours while being cooled by water. Then, this dispersion liquid was placed in a centrifuge separator to remove large particles. Then, the final prepared matter of yellow pigment dispersion was obtained that had a solid content of about 12.5% by weight, and an average particle diameter of 120 nm.

(2) Preparation of Ink

A yellow ink was prepared by mixing the above yellow pigment dispersion element with the following components to sufficiently agitate the resultant mixture to subject the mixture to pressurization and filtering by a micro filter having pore size of 1.0 μm (made by FUJI FILM Co.) to prepare the ink.

The above yellow pigment dispersion element of 40 parts
Glycerin of 9 parts
Ethylene glycol of 6 parts
Acetylene glycol ethylene oxide addition product (article name: Acetyrenol EH) of 1 part
1,2-hexanediol of 3 parts
Polyethylene glycol (molecular weight of 1000) of 4 parts
Ion-exchanged water of 37 parts (Magenta Ink)

(1) Preparation of Dispersion Liquid

First, benzyl acrylate and methacrylic acid were used as raw material in the common procedure to prepare an AB-type block polymer having an acid value of 300 and a number average molecular weight of 2500. The AB-type block polymer was neutralized by potassium hydroxide aqueous solution and was diluted by ion-exchanged water to obtain homogeneous polymer aqueous solution of 50 mass %. The above polymer solution of 100 g and C.I. pigment red 122 of 100 g was mixed with ion-exchanged water of 300 g and the resultant mixture was mechanically agitated for 0.5 hours. Next, a microfluidizer was used to send the above mixture through an interaction chamber five times under a fluid pressure of about 70 MPa. Then, this dispersion liquid was subjected to a centrifugal separation processing to remove large particles. As a result, the final prepared matter of magenta dispersion liquid was obtained that had a pigment concentration of 10 mass % and a dispersant concentration of 5 mass %.

(2) Preparation of Ink

A magenta ink was prepared by mixing the above magenta dispersion liquid with the following components to sufficiently agitate the resultant mixture. Then, a micro filter (made by FUJI FILM Co.) having a pore size of 2.5 μm was used to subject the mixture to pressurization and filtering to prepare the ink having a pigment concentration of 4 mass % and a dispersant concentration of 2 mass %.

The above magenta dispersion liquid of 40 parts
Glycerin of 10 parts
Diethylene glycol of 10 parts
Acetylene glycol EO addition product of 0.5 parts
Ion-exchanged water of 39.5 parts (Cyan Ink)

(1) Preparation of Dispersion Liquid

First, benzyl acrylate and methacrylic acid were used as raw material in the common procedure to prepare an AB-type block polymer having an acid value of 250 and a number average molecular weight of 3000. The AB-type block polymer was neutralized by potassium hydroxide aqueous solution and was diluted by ion-exchanged water to obtain homogeneous polymer aqueous solution of 50 mass %. Then, the above polymer solution of 180 g was mixed with C.I. pigment blue 15:3 of 100 g and ion-exchanged water of 220 g and the mixture was mechanically agitated for 0.5 hours. Next, a microfluidizer was used to send the above mixture through an interaction chamber five times under a fluid pressure of about 70 MPa. Then, this dispersion liquid was subjected to a centrifugal separation processing to remove large particles. As a result, the final prepared matter of cyan dispersion liquid was obtained that had a pigment concentration of 10 mass % and a dispersant concentration of 10 mass %.

(2) Preparation of Ink

A cyan ink was prepared by mixing the above cyan dispersion liquid with the following components to sufficiently agitate the resultant mixture. Then, a micro filter (made by FUJI FILM Co.) having a pore size of 2.5 μm was used to subject the mixture to pressurization and filtering to prepare the ink having a pigment concentration of 2 mass % and a dispersant concentration of 3 mass %.

The above cyan dispersion liquid of 20 parts
Glycerin of 10 parts
Diethylene glycol of 10 parts
Acetylene glycol EO addition product of 0.5 parts
Ion-exchanged water of 53.5 parts (Black Ink)

(1) Preparation of Dispersion Liquid

Polymer aqueous solution used for the yellow ink of 100 g, carbon black of 100 g, and ion-exchanged water of 300 g were mixed and the mixture was mechanically agitated for 0.5 hours. Next, a microfluidizer was used to send this mixture through an interaction chamber 5 times under a fluid pressure of about 70 MPa. Then, this dispersion liquid was subjected to a centrifugal separation processing to remove large particles. As a result, the final prepared matter of black dispersion liquid was obtained that had a pigment concentration of 10 mass % and a dispersant concentration of 6 mass %.

(2) Preparation of Ink

A black ink was prepared by mixing the above black dispersion liquid with the following components to sufficiently agitate the resultant mixture. Then, a micro filter (made by FUJI FILM Co.) having a pore size of 2.5 μm was used to subject the mixture to pressurization and filtering to prepare the ink having a pigment concentration of 5 mass % and a dispersant concentration of 3 mass %.

The above black dispersion liquid of 50 parts
Glycerin of 10 parts
Triethylene glycol of 10 parts
Acetylene glycol EO addition product of 0.5 parts
Ion-exchanged water of 25.5 parts (Processing Liquid)

(1) Preparation of Processing Liquid

The following components were mixed and the mixture was sufficiently agitated to prepare a processing liquid.

Commercially-available acryl silicone copolymer (article name: Simac US-450 made by TOAGOSEI Co.) of 5 parts
Glycerin of 5 parts
Ethylene glycol of 15 parts
Acetylene glycol ethylene oxide addition product (article name: Acetyrenol EH) of 0.5 parts
Ion-exchanged water of 74.5 parts It is important that the processing liquid of this embodiment includes transparent resin material for the purpose of forming a transparent layer on the outermost surface of an image to improve the abrasion resistance. Such transparent resin material maybe transparent resin material copolymerized with a polydimethylsiloxane component. The use of this can provide a slippage property to efficiently reduce the dynamic friction coefficient. In this embodiment, transparent resin material copolymerized with a commercially-available polydimethylsiloxane component (the above-described acryl silicone copolymer: Simac US-450) is used. This processing liquid also maybe referred as coat ink, surface coat ink, clear ink, or reaction liquid.

Figure 21:
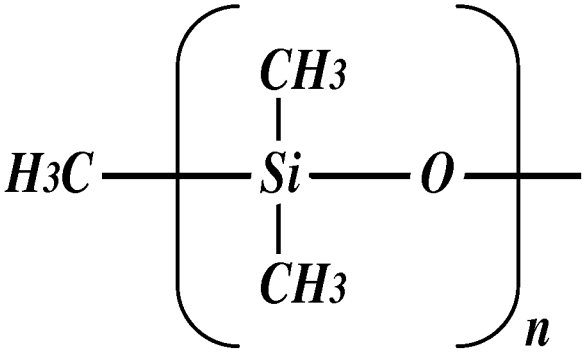
FIG. 21 is a schematic view of the chemical structure of a polydimethylsiloxane component used for the processing liquid.

FIG. 21 is a schematic diagram illustrating a general polydimethylsiloxane component. A polydimethylsiloxane component is structured so that a siloxane bonded chain of (Si—O—Si) is surrounded by methyl groups (—CH3) and thus has a molecular structure having a low polarity. Thus, a polydimethylsiloxane-base compound has a property according to which the compound moves to the surface of the transparent layer formed by the processing liquid used in this embodiment or the interface to localize at the surface, and localizes in the surface or the interface, and the neighborhood thereof. As a result, the transparent layer has a reduced surface energy to reduce the affinity between the transparent layer and a nail of a human. Thus, it is considered that the dynamic friction coefficient can be remarkably reduced.

Another transparent resin material providing the slippage property may be obtained by adding silicone oil to acryl-base resin. However, any resin material also may be used so long as the material can be used to form the transparent layer on the outermost surface of the pigment ink layer to reduce the dynamic friction coefficient.

(Printing Operation)

Next, the printing operation in this embodiment will be described. In this example, the multi-path printing method is used by which five scannings are performed to form, for every one pixel (for every predetermined region), an image layer formed by an ink and a transparent layer formed by a processing liquid. The printing method performs four scannings to eject the respective color inks of cyan (C), magenta (M), yellow (Y), and black (K) to print an image in a predetermined region. At the four scannings and the subsequent fifth scanning, the processing liquid is ejected to form the transparent layer. In order to simplify the description of the printing operation, the following section will assume that ink used for the printing of the image is only cyan (C) ink and magenta (M) ink.

Figure 5:
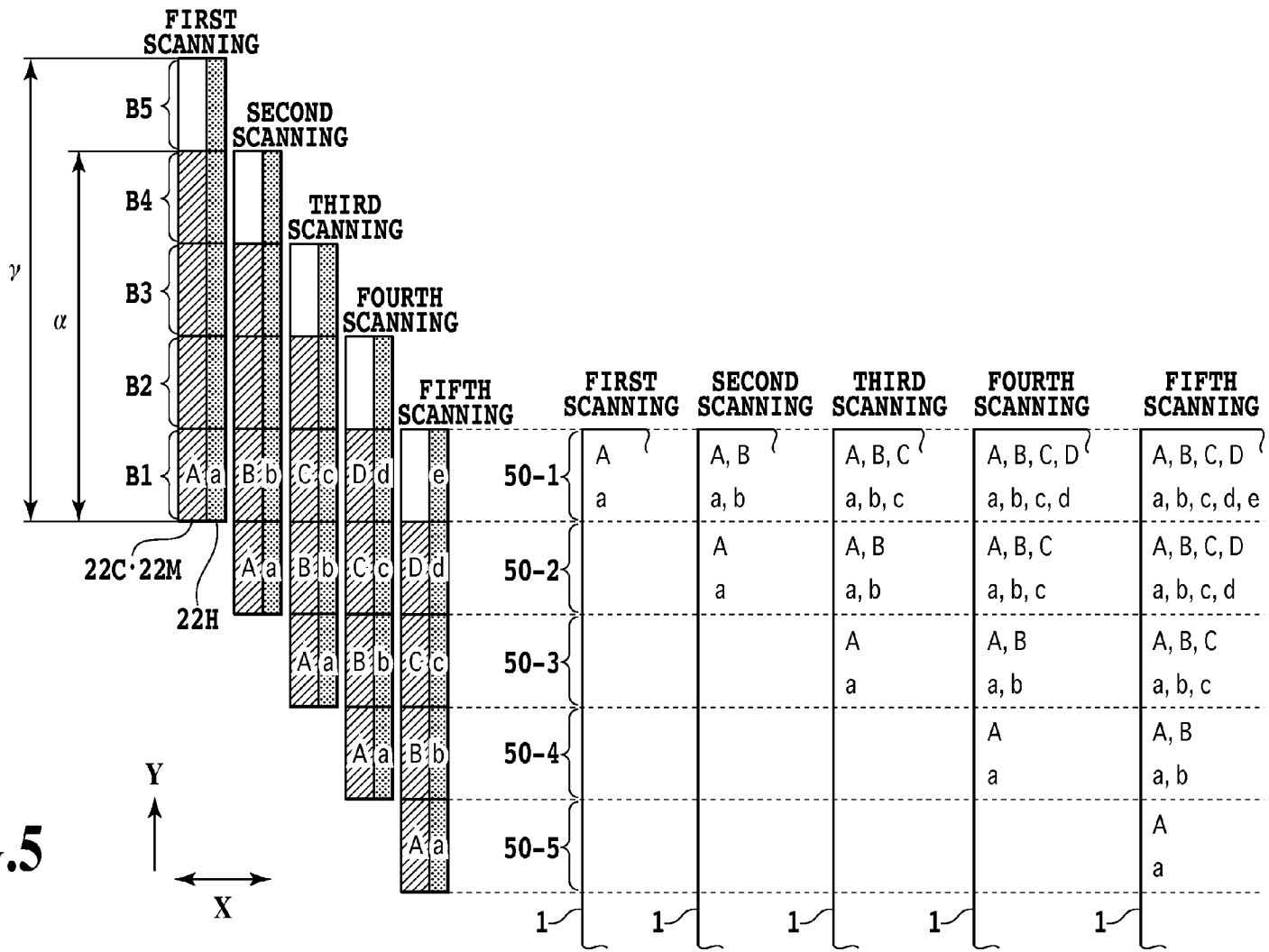
FIG. 5 illustrates a printing method in the first embodiment of the present invention.

FIG. 5 illustrates the printing method in this example. The printing heads 22C and 22M for ejecting the cyan (C) ink and magenta (M) ink and the printing head 22H for ejecting the processing liquid are divided to five blocks B1, B2, B3, B4, and B5 for which the total of 1280 ejection openings are divided to 256 ejection openings for each of the blocks. In the printing heads 22C and 22M, 1024 ejection openings in an area $\alpha$ from blocks B1 to B4 (see FIG. 2) are used. In the following description, the ejection openings of these blocks B1 to B4 are also called ejection openings of A, B, C, and D regions. In the printing head 22H, 1280 ejection openings in an area $\gamma$ of all blocks B1 to B5 (see FIG. 2) are used. In the following description, the ejection openings of these blocks B1 to B5 are also called the ejection openings of a, b, c, d, and e regions. In FIG. 5, each of 50-1, 50-2, 50-3, . . . and so on denotes printing regions on the printing medium 1 corresponding to one block of the printing head.

First, in the first scanning, based on the ejection data at the first scanning of the printing region 50-1, the ink is ejected through the ejection openings of the regions A of the printing heads 22C and 22M. Based on the ejection data for the processing liquid at the first scanning, the processing liquid is ejected through the ejection openings of the region a of the printing head 22H.

Next, the printing medium 1 is transported in the sub-scanning direction (direction shown by the arrow Y) in an amount ⅕ of the length of the printing head. In FIG. 5, the printing head is shown as having a relative movement in the opposite direction to the sub-scanning direction. In the subsequent second scanning, based on the ejection data at the second scanning of the printing region 50-1, the ink is ejected through the ejection openings of the region B of the printing heads 22C and 22M. Based on the ejection data for the processing liquid at the second scanning, the processing liquid is ejected through the ejection openings of the region b of the printing head 22H. In this second scanning, the printing region 50-2 is subjected to the first scanning.

Next, the printing medium 1 is transported in the sub-scanning direction in an amount ⅕ of the length of the printing head. In the subsequent third scanning, based on the ejection data at the third scanning of the printing region 50-1, the ink is ejected through the ejection openings of the region C of the printing heads 22C and 22M. Based on the ejection data for the processing liquid at the third scanning, the processing liquid is ejected through the ejection openings of the region c of the printing head 22H. In this third scanning, the second scanning to the printing region 50-2 and the first scanning to the printing region 50-3 are performed.

Next, the printing medium 1 is transported in the sub-scanning direction in an amount ⅕ of the length of the printing head. In the subsequent fourth scanning, based on the ejection data at the fourth scanning of the printing region 50-1, the ink is ejected through the ejection openings of the region D of the printing heads 22C and 22M. Based on the ejection data for the processing liquid at the fourth scanning, the processing liquid is ejected through the ejection openings of the region d of the printing head 22H. In this fourth scanning, the third scanning to printing region 50-2, the second scanning to the printing region 50-3, and the first scanning to the printing region 50-4 are performed.

Through the first to fourth scannings, the printing of the image on the printing region 50-1 by the cyan (C) ink and magenta (M) ink is completed.

Next, the printing medium 1 is transported in the sub-scanning direction in an amount ⅕ of the length of the printing head. In the subsequent fifth scanning, based on the ejection data for the processing liquid at the fifth scanning, the processing liquid is ejected through the ejection openings of the region e of the printing head 22H. As a result, the application of the processing liquid to the printing region 50-1 (i.e., the formation of the transparent layer 26) is completed. In this fifth scanning, the fourth scanning to the printing region 50-2, the third scanning to the printing region 50-3, the second scanning to the printing region 50-4, and the first scanning to the printing region 50-5 are performed.

Thereafter, similar scanning is repeated to consecutively complete the printing of the image to the printing regions 50-2 and 50-3, . . . and so on and the formation of the transparent layer 26.

Figure 22A:
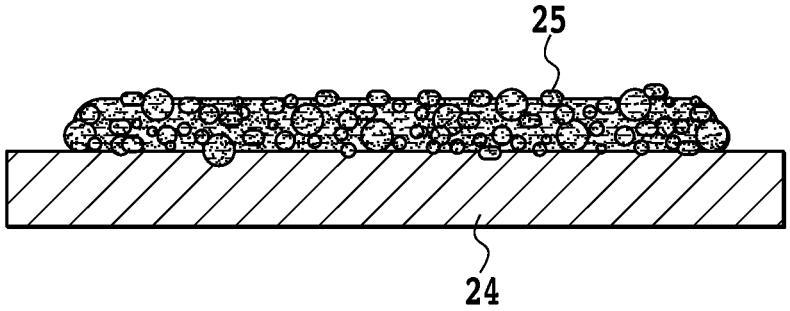
FIG. 22A is a schematic view illustrating the cross section of a printed image formed by pigment ink on a printing medium having thereon an ink absorbing layer.
Figure 22B:
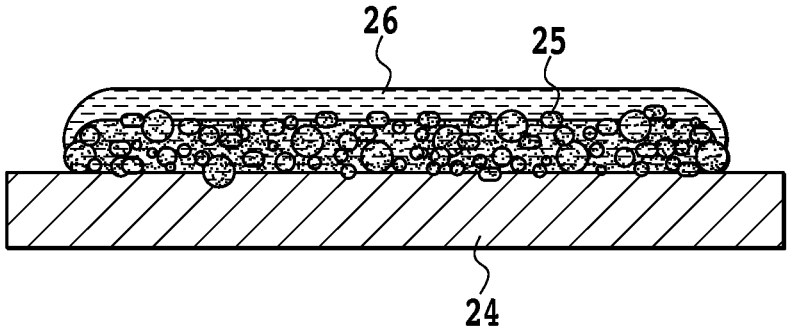
FIG. 22B is a schematic view illustrating the cross section of a printed image formed by the processing liquid to form a transparent layer on an outermost surface.

When a pigment ink is used to form an image on glossy paper, as described above with reference to FIG. 22A, coloring pigment particles cannot enter the interior of the ink absorbing layer 24 and the pigment ink layer 25 is formed on the surface of the ink absorbing layer 24. Thus, when an external force is directly applied to the pigment ink layer 25, the image surface is easily damaged, and the pigment ink layer 25 may be peeled. In an actual usage environment, for example, in a handling process where the printing medium is rolled or is adhered to a wall, when the printing medium contacts a nail, the image is significantly damaged and the pigment ink layer 25 may be completely peeled from the ink absorbing layer 24 in some cases. On the other hand, when the processing liquid is used to form the transparent layer 26 so as to cover the outermost surface of the pigment ink layer 25 as shown in FIG. 22B, the pigment ink layer does not have direct contact with a nail or the like, thus suppressing peeling of the pigment ink layer. The direct protection of the pigment ink layer as described above is very effective to improve the abrasion resistance.

(Configuration Example of Image Processing System)

Figure 3:
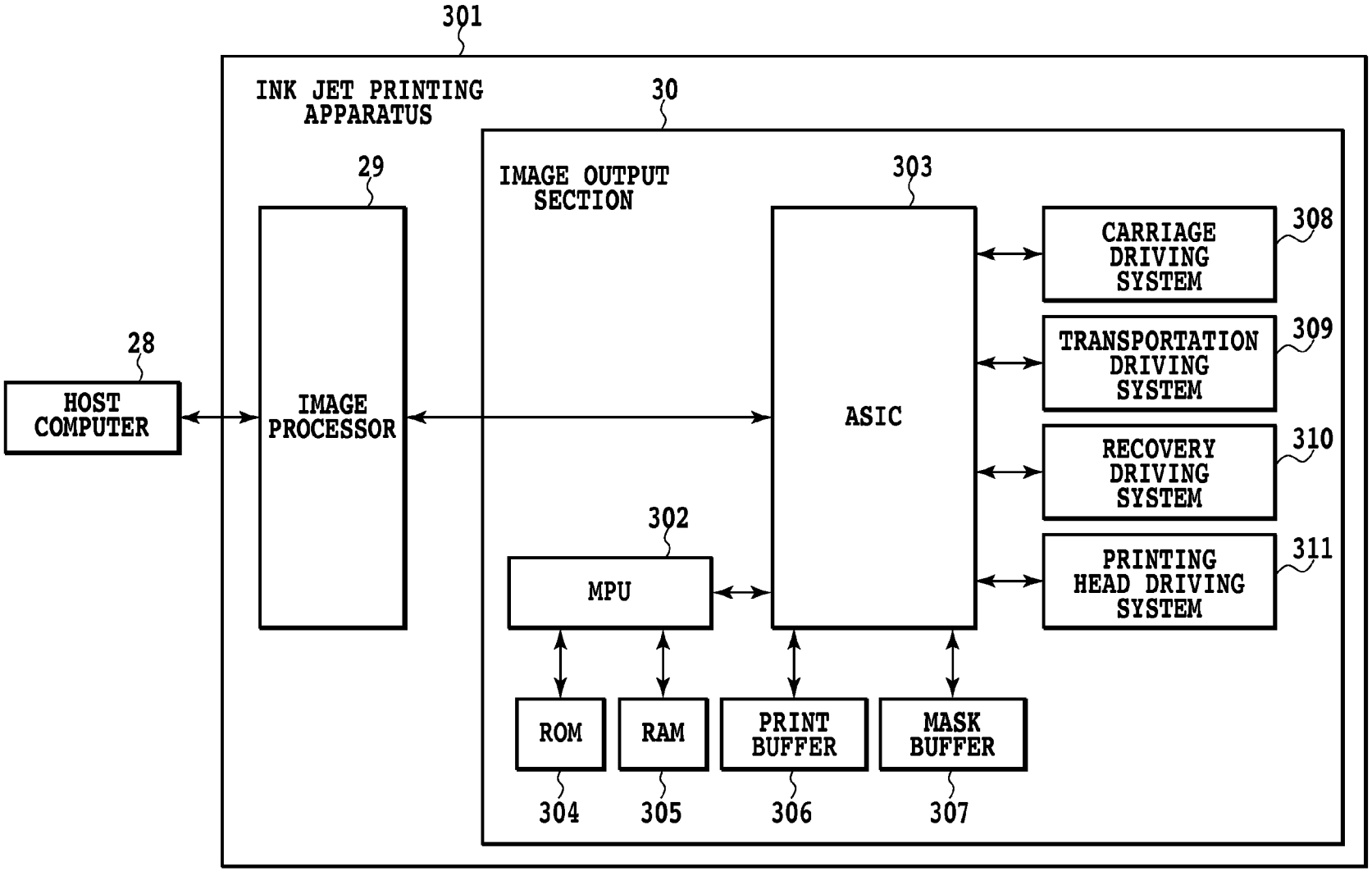
FIG. 3 is a block diagram illustrating a control system in an ink jet printing apparatus that is a representative embodiment of the present invention.

FIG. 3 is a block diagram illustrating the control system in an ink jet apparatus that is a representative embodiment of the present invention. A host computer (image input section) 28 sends multi-valued image data stored in various storage media such as a hard disk to an image processor 29 in an ink jet printing apparatus 301. The multi-valued image data also can be sent from an image input device connected to the host computer 28 (e.g., scanner, digital camera). The image processor 29 subjects the inputted multi-valued image data to image processing (which will be described later) to convert the data to binary image data. As a result, binary image data (ink ejection data) for ejecting a plurality of types of pigment inks through a printing head is generated. Binary image data for ejecting the processing liquid (processing liquid ejection data) is also generated. Based on binary image data for at least two types of pigment inks and the processing liquid sent from the image processor 29, an image output section 30 applies the pigment ink and the processing liquid to the printing medium to print an image thereon.

The image output section 30 is controlled by a Micro Processor Unit (MPU) 302 based on a program stored in a ROM 304. A RAM 305 is used as an operation area or a temporary data storage area of the MPU 302. The MPU 302 controls, via an ASIC 303, a carriage driving system 308, a printing medium transportation driving system 309, a printing head recovery driving system 310, and a printing head driving system 311. The MPU 302 is structured so as to read data from and write data to a print buffer 306 via the ASIC 303.

The print buffer 306 temporarily stores image data converted to a format by which the data can be transferred to the printing head. A mask buffer 307 temporarily stores a predetermined mask pattern for optionally subjecting the data transferred from the print buffer 306 to the printing head to an AND processing. It is noted the plurality of sets of mask patterns for a plurality of multi-path printings having different numbers of paths are prepared in the ROM 304. In an actual printing, the applicable mask pattern is read from the ROM 304 and is stored in the mask buffer 307.

(Method of Generating Ejection Data for Processing Liquid)

Figure 4:
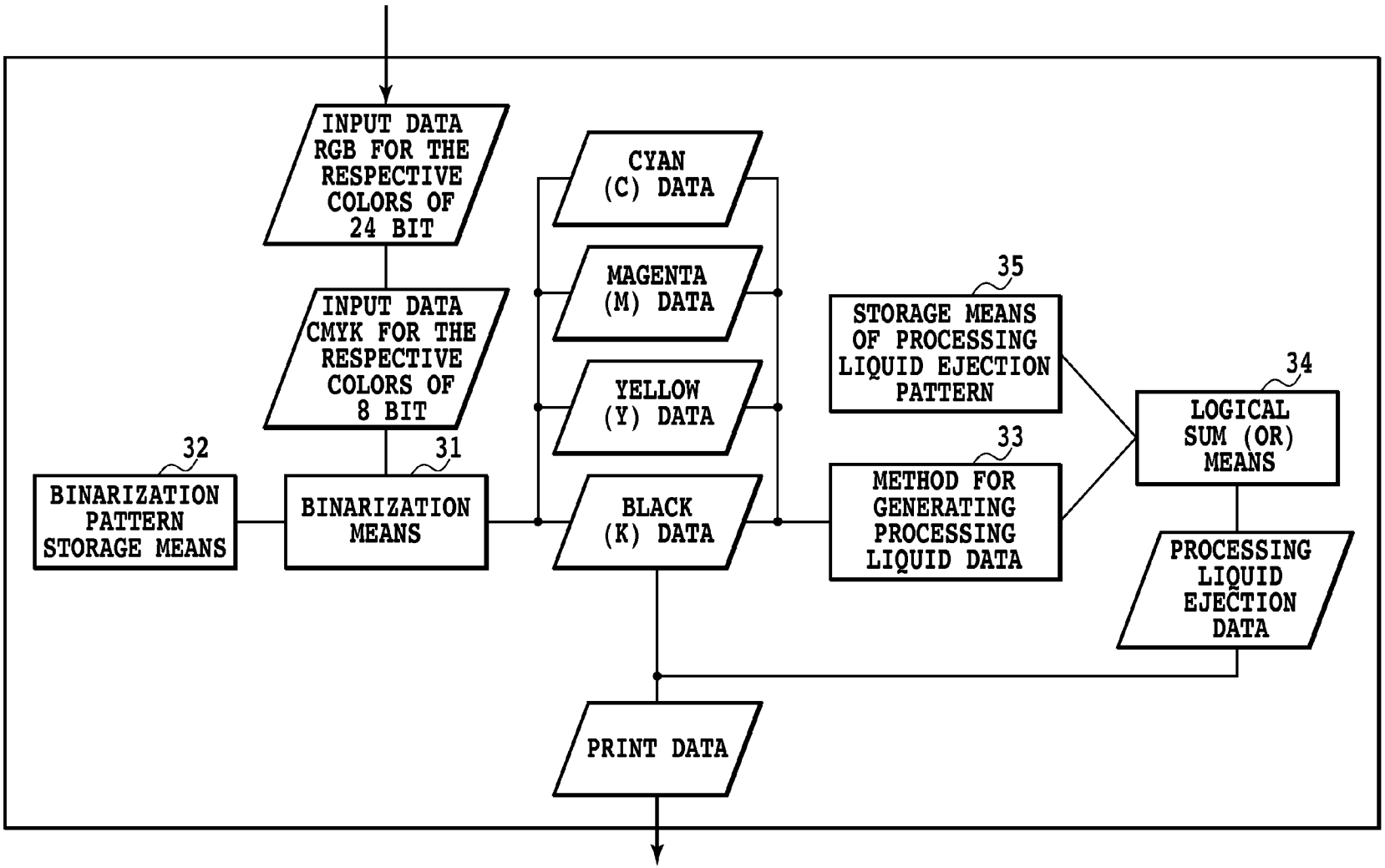
FIG. 4 is a block diagram illustrating an image processor in FIG. 3.

Next, a method of generating the ejection data for the processing liquid in this embodiment will be described with reference to FIG. 4. FIG. 4 is a block diagram illustrating the image processor 29 of FIG. 3. This image processor 29 generates ejection data for the pigment ink and generates ejection data for the processing liquid based on the ejection data for the pigment ink.

Specifically, first, RGB-type multi-valued image data is inputted through the image input section 28. Next, the RGB-type multi-valued image data is converted to multi-valued image data corresponding to the respective plurality of types of the inks (K, C, M, and Y) used for the printing of an image. Next, a binarization unit 31 develops, based on the pattern stored in the binarization pattern storage unit 32, multi-valued image data corresponding to the respective types of the inks to binary bit map data corresponding to the respective types of the inks. As a result, binary image data (ink ejection data) for applying the respective plurality of types of the pigment inks is generated.

The processing liquid ejection data for applying the processing liquid is generated based on the binary image data for the plurality of types of the pigment inks (ink ejection data) thus generated. This processing liquid ejection data is generated by a processing liquid pattern storage unit 35, a processing liquid data generation unit 33, and a logical sum computation processing unit (OR circuit) 34.

Figures 6, 7:
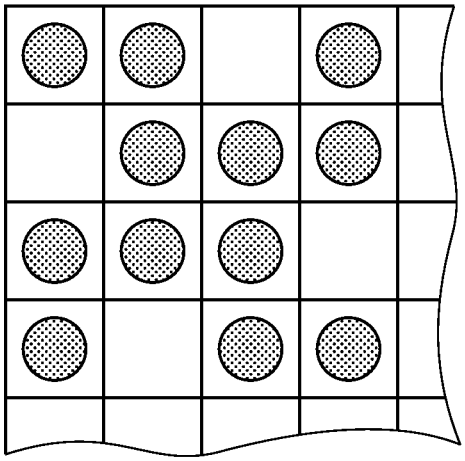
FIG. 6 illustrates a processing liquid mask pattern stored in a processing liquid pattern storage means of FIG. 4.
FIG. 7 illustrates the arrangement of dots formed by cyan ink and magenta ink.
Figure 8A:
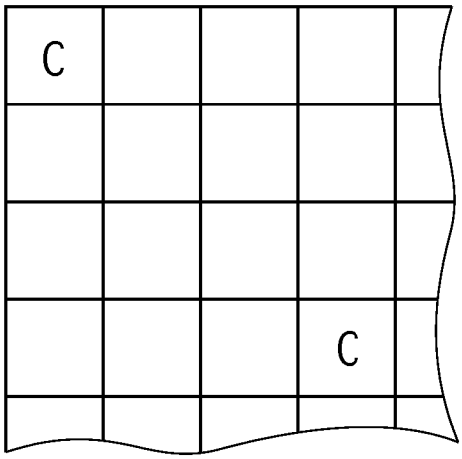
FIG. 8A to FIG. 8D illustrate the ejection data for cyan ink in the first scanning to the fourth scanning in FIG. 5, respectively.
Figure 8B:
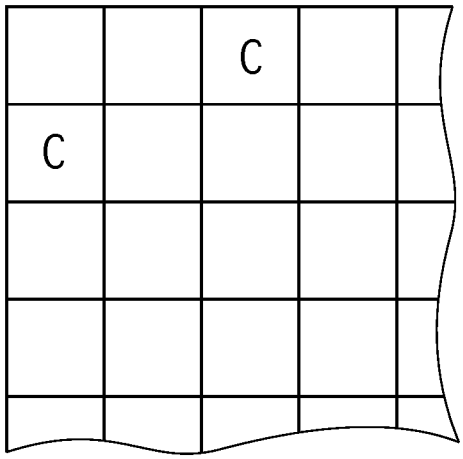
Figure 8C:
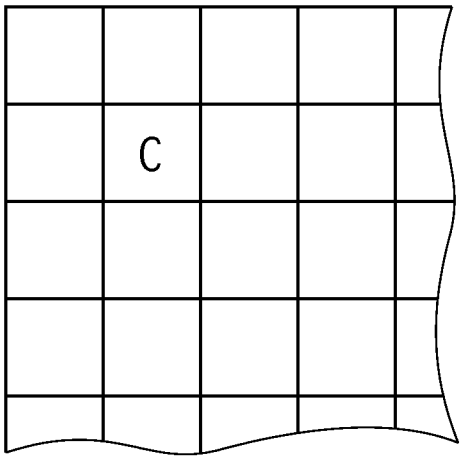
Figure 8D:
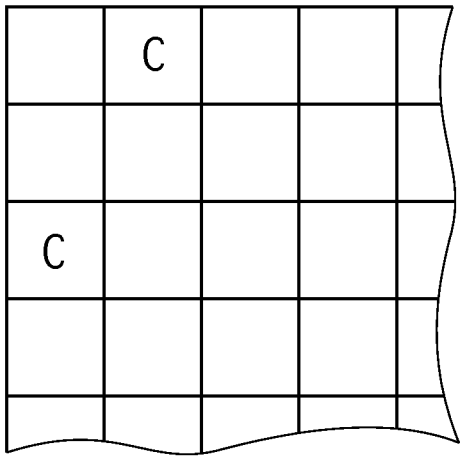
Figure 9A:
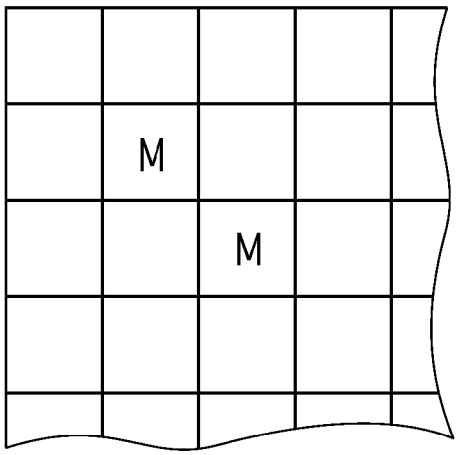
FIG. 9A to FIG. 9D illustrate the ejection data for magenta ink in the first scanning to the fourth scanning in FIG. 5, respectively.
Figure 9B:
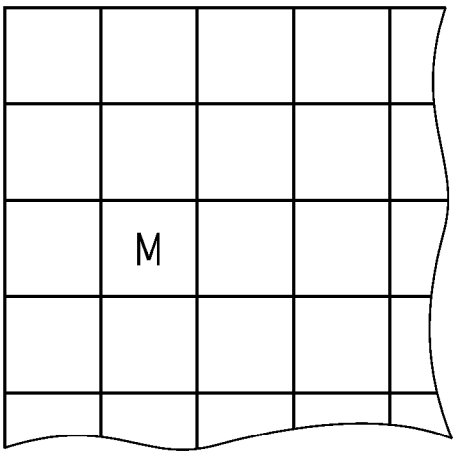
Figure 9C:
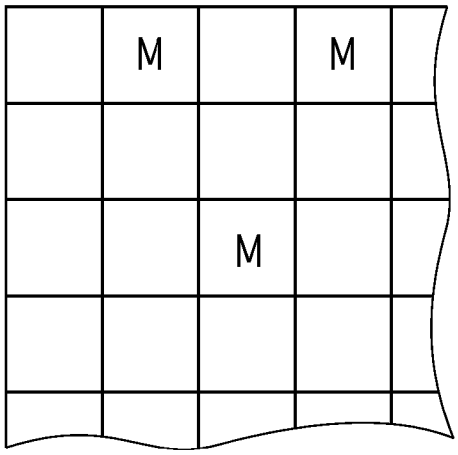
Figure 9D:
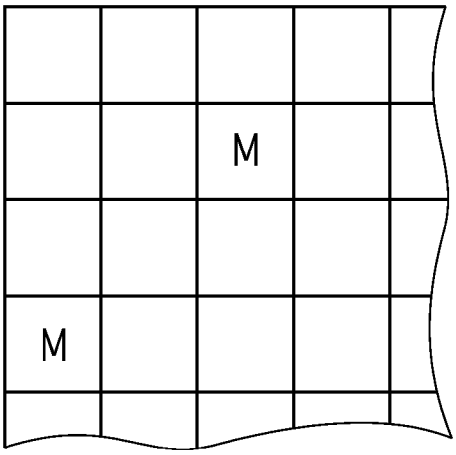
Figure 14A:
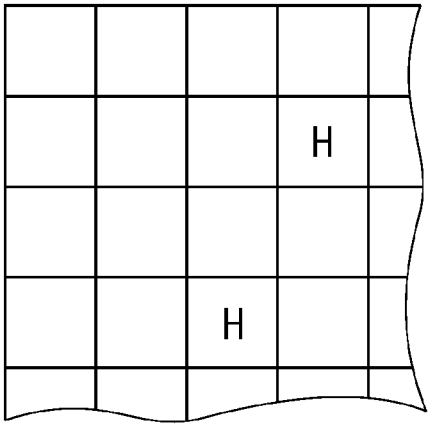
FIG. 14A to FIG. 14E illustrate ejection data for a processing liquid in the first scanning to the fifth scanning in FIG. 5, respectively.
Figure 14B:
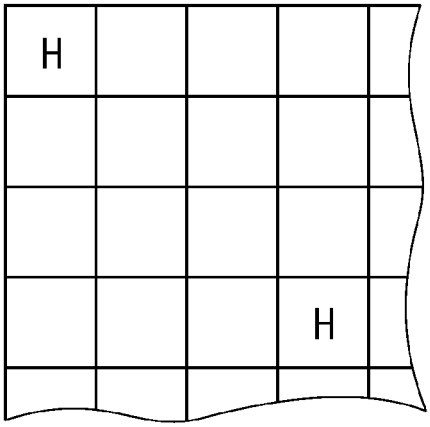
Figure 14C:
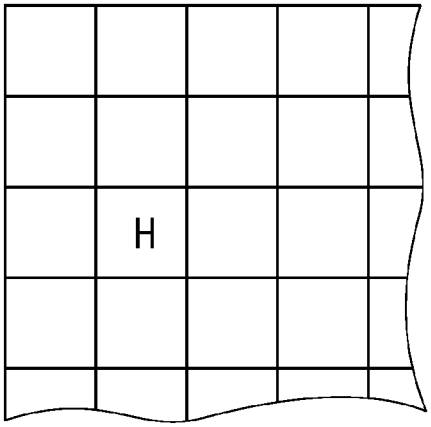
Figure 14D:
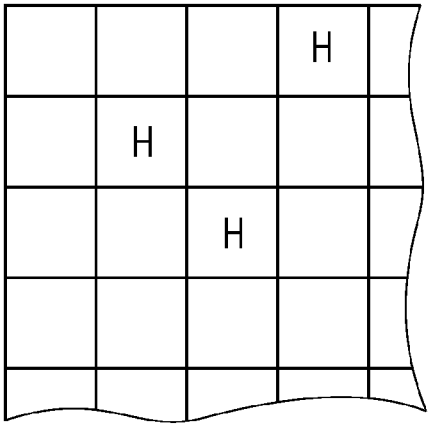
Figure 14E:
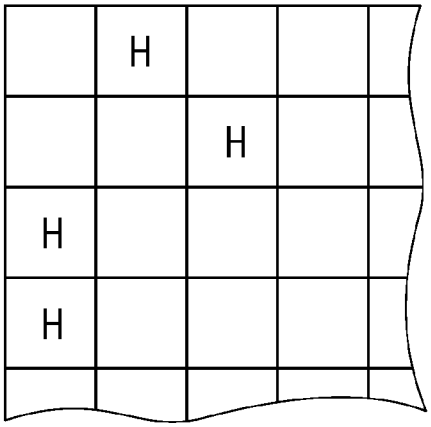

FIG. 6 illustrates a mask pattern for the processing liquid (processing liquid mask pattern) stored in the processing liquid pattern storage unit 35. This processing liquid mask pattern and binary image data for the processing generated based on the binary image data for the plurality of types of the pigment inks (ink ejection data) are subjected to OR processing to generate thinned-out binary image data for the processing liquid. This processing liquid mask pattern can be used to thin out binary image data for the processing liquid (processing liquid binary image data) generated having a printing duty of 100% in an unit matrix of 4×4 pixels to obtain thinned-out binary image data for the processing liquid (processing liquid thinned-out binary image) having a print duty of 75% (the number of ink ejections (the number of formed ink dots) of 75%.) In the present invention, the entire surface of the pigment ink layer 25 is not always required to be covered by the transparent layer 26 of the processing liquid as shown in FIG. 22B. The pigment ink layer 25 also may be partially covered by the pigment ink layer 25. Specifically, the abrasion resistance can be improved so long as the pigment ink layer is covered by the transparent layer so that the pigment ink layer can be prevented from directly receiving an external force.

In this embodiment, the transparent layer 26 covering about 75% of the ink layer 25 formed by the pigment ink on a glossy paper (printing medium) as shown in FIG. 22B also can suppress the peeling or damage of an image surface due to contact with a nail or similar hard object, thus providing a favorable abrasion resistance. Based on the concept as described above, the mask pattern of FIG. 6 for thinning out the processing liquid binary image data with a ratio of 75% is stored as the processing liquid mask pattern. This processing liquid mask pattern also may be a pattern for generating the processing liquid binary image data so that the transparent layer 26 covers 100% of the ink layer 25.

Next, a method for generating the processing liquid ejection data (processing liquid binary image data) will be described by exemplarily describing the method for the cyan (C) and magenta (M) inks among the pigment inks used in this embodiment.

As described above, the binarization unit 31 of FIG. 4 binarizes the bit map (C and M data) for the cyan (C) ink and the magenta (M) ink. When the binarized C and M data are as shown in FIG. 7 for example that is to form ink dots of the cyan (C) and magenta (M) inks in a printing region 50-1 (see FIG. 5), the following image processing is performed to generate the processing liquid ejection data. In FIG. 7, the data C for forming dots of the cyan (C) ink is represented as "C" and the data M for forming dots of magenta (M) is represented as "M". This representation also applies to other drawings.

First, based on the binary bit map (C and M data) for the cyan (C) and magenta (M) inks, the processing liquid data generation unit 33 (see FIG. 4) detects, with regards to every pixel, an order of scanning among a plurality of scannings at which the formation of an image by these inks is completed. To achieve this, the processing liquid data generation unit 33 divides the data C and data M to pieces of data for the first scanning to the fourth scanning. The C and M data in the first, second, third, and fourth scannings of the printing region 50-1 corresponds to regions A, B, C, and D in the printing heads 22C and 22M (see FIG. 5). In this example, the data C is divided as shown in FIG. 8A to FIG. 8D and the data M is divided as shown in FIG. 9A to FIG. 9D. Then, as shown in FIG. 10A to FIG. 10D, the sum of the data C and the data M is calculated in each scanning. FIG. 11 shows the first scanning data (FIG. 10A) as "1", the second scanning data (FIG. 10B) as "2", the third scanning data (FIG. 10C) as "3", and the fourth scanning data (FIG. 10D) as "4". When different pieces of scanning data correspond to a single pixel, data having a larger value is used. The reason is to sense a scanning at which the formation of the image by the inks is completed.

In the manner as described above, for each one pixel (for a predetermined region), an order of the scanning, among the plurality of scannings for forming the image, at which the image formation is completed (image formation completion scanning) is detected. Specifically, based on the data of FIG. 10A to FIG. 10D, the scanning number (1 to 4) at which the image formation is completed is detected. As will be described later, the processing liquid is ejected in two or more scanning after this image formation completion scanning.

Next, as shown in FIG. 12, "1" is added to the values of FIG. 11. As a result, the scanning number at the completion of the image formation by the inks is converted to the scanning number at which the formation of the transparent layer by the processing liquid is started. In FIG. 11, a margin pixel originally having no data is assumed as a pixel for which the image formation is already completed. For such a pixel, "1" is added so that the processing liquid can be ejected in the first scanning as will be described later. The above procedure is the processing conducted in the processing liquid data generation unit 33.

Next, the logical sum computation processing unit (OR circuit) 34 calculates the logical sum of the pattern of FIG. 6 previously stored in the processing liquid pattern storage unit 35 and the data generated by the processing liquid data generation unit 33 of FIG. 12 to generate the data of FIG. 13. This data is allocated to the first scanning to the fifth scanning by the printing head 22H for ejecting the processing liquid. Specifically, the data calculated by means of logical sum is allocated, as shown in FIG. 14A to FIG. 14E, to the first, second, third, fourth, and fifth scannings in accordance with values of "1", "2", "3", "4", and "5. In FIG. 14A to FIG. 14E, processing liquid ejection data (dots data) is represented as "H". As described above, the first, second, third, fourth, and fifth scannings use the ejection openings in the entire area γ (regions a, b, c, d, and e) in the printing head 22H.

By generating the processing liquid ejection data for the respective scannings as described above, the entire area γ of the regions of the printing head 22H for ejecting the processing liquid can be used as described above to eject the processing liquid. It is noted that the method for generating the processing liquid ejection data based on the ejection data of the respective ink colors and the method for distributing the processing liquid ejection data to the respective scannings are not limited to the above-described methods.

The ejection data for the respective ink colors and the processing liquid ejection data are sent as print data to the image output section 30. Based on the print data, the image output section 30 forms the image and the transparent layer as described above.

Figure 23:
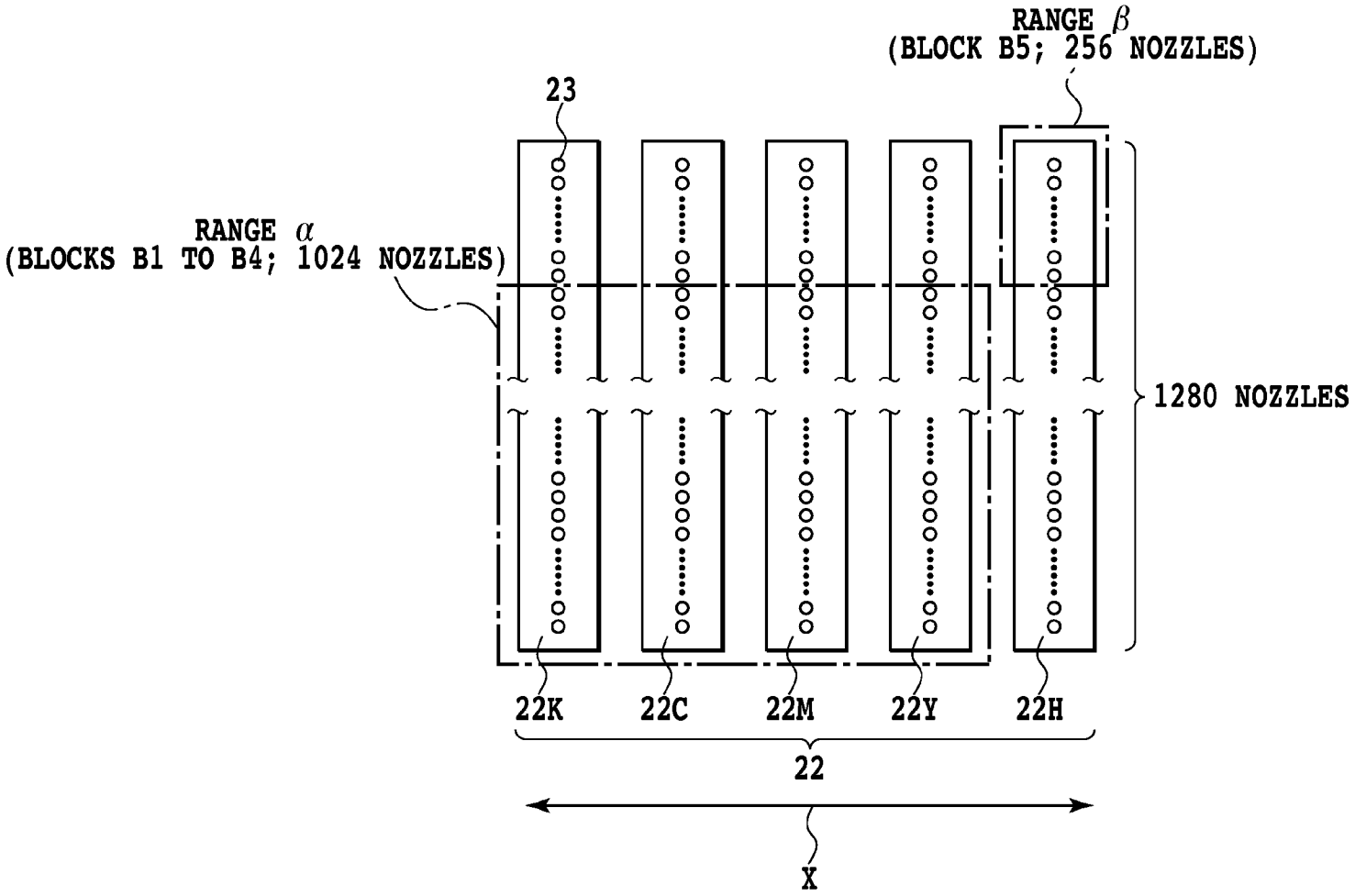
FIG. 23 illustrates a printing head used in a printing method as a comparison example seen from the ejection opening side.

As described above, in this embodiment, an order of the scanning (image formation completion scanning) at which the image formation is completed is detected, among a plurality of scannings for forming the image, for each one pixel (for each predetermined area). Specifically, the image formation completion scanning is detected for each one pixel and the processing liquid is ejected on and after the scanning next to the detected scanning. Thus, among the ink and the processing liquid ejected for each one pixel, the processing liquid is finally ejected to form the transparent layer so as to cover the dots of the respective colors of the inks for forming the image. The transparent layer can improve the abrasion resistance of the image. The processing liquid is ejected by ejection openings in the entire area of the printing head 21H. Thus, the nozzle can have an improved durability. When it is assumed that the processing liquid is ejected in the final scanning (the fifth scanning) among a plurality of scannings, the ejection openings in the area β of the printing head 21H in FIG. 23 are used in a concentrated manner, thus causing a risk where the nozzle may have a deteriorated durability. Furthermore, by allocating the processing liquid ejection data to a plurality of scannings, the drying of dots of the processing liquid on the printing medium and the image can be speeded up to remedy problems in the image performance such as a flooded ink phenomenon, and a interference pattern phenomenon due to the transparent layer finished to have a mirror surface.

(Second Embodiment)

FIG. 15 to FIG. 20E illustrate a second embodiment of the present invention. In this embodiment, a mask pattern for dividing ejection data for respective colors of inks into a plurality of scannings is used to set a mask pattern for dividing the processing liquid ejection data into a plurality of scannings. The set mask pattern is previously prepared. In the case of this example, the processing liquid is ejected in two scannings—the final scanning and the previous scanning—to form the transparent layer. As will be described later, with regard to both a pixel having ejection data for the respective colors of the inks and a pixel having no such ejection data (margin pixel), whether the processing liquid is ejected or not is determined based on the mask pattern for the ejection of the processing liquid.

As in the first embodiment, this embodiment is explained with the assumption that it uses the printing method to form the image through four scannings by the pigment inks of cyan (C) and magenta (M) only. The same parts as those of the above-described first embodiment will not be described further.

Figure 15:
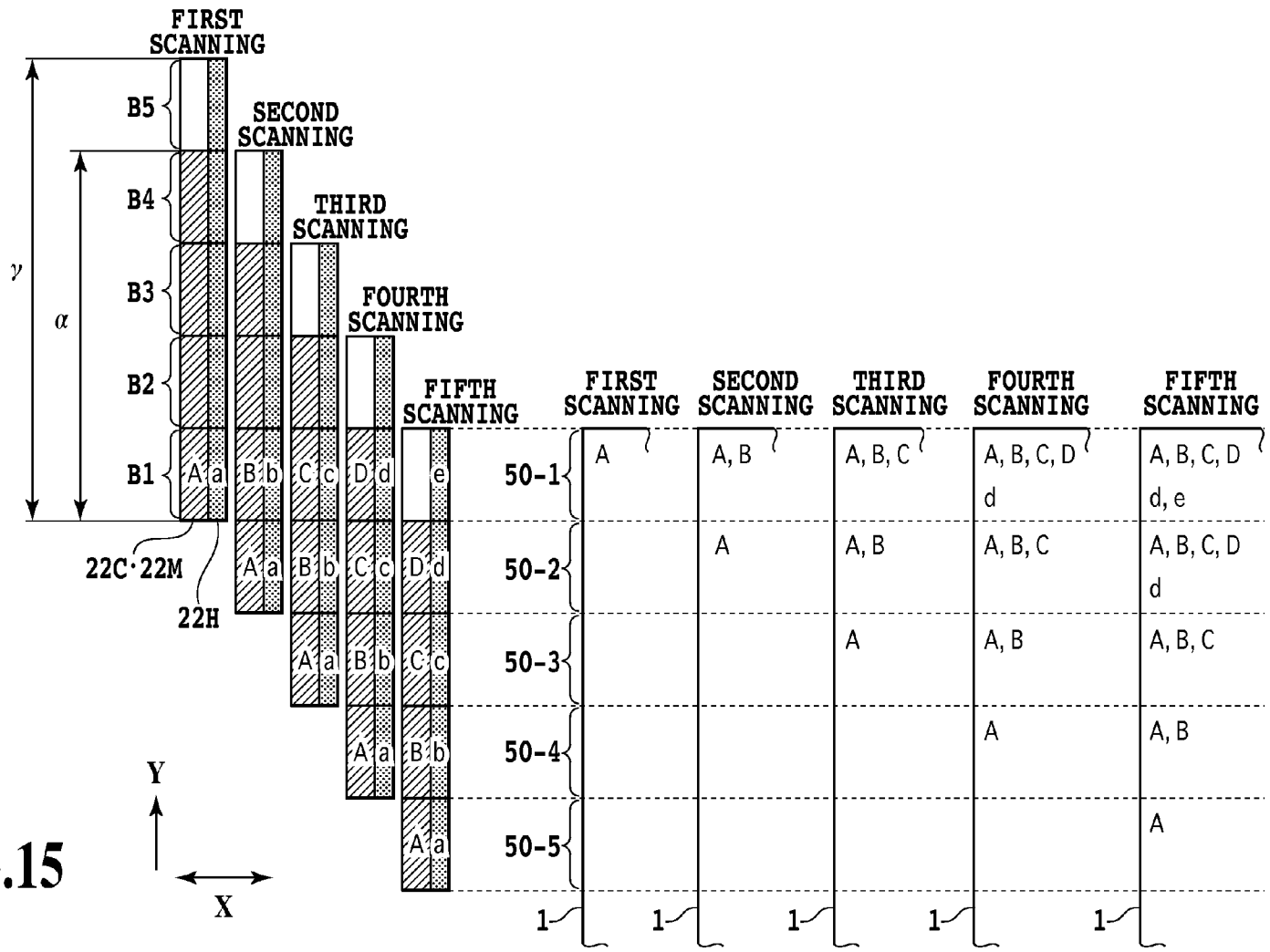
FIG. 15 illustrates the printing method in the second embodiment of the present invention.
Figure 16A:
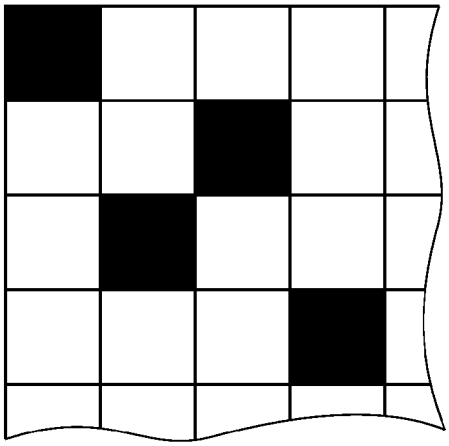
FIG. 16A to FIG. 16D illustrate random mask patterns for ejecting cyan ink.
Figure 16B:
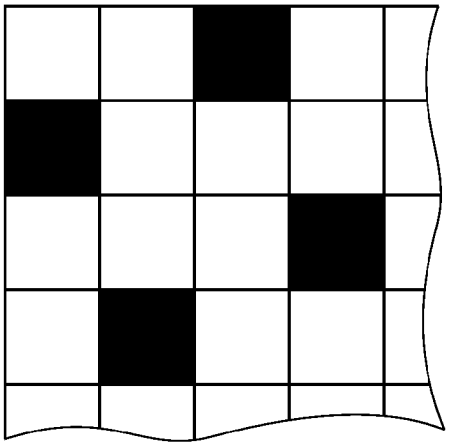
Figure 16C:
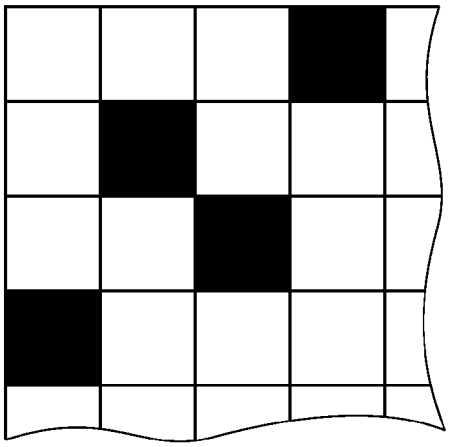
Figure 16D:
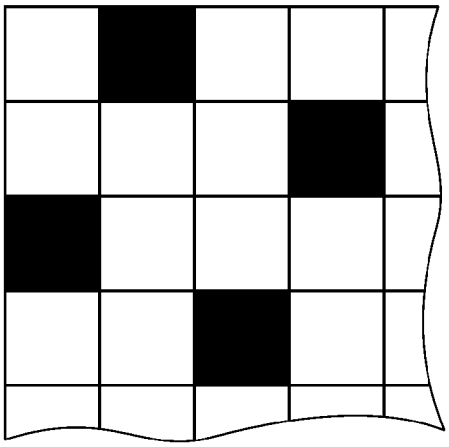

FIG. 15 illustrates the printing method in this embodiment. As in the above-described embodiment, the first to fourth scannings are carried out to complete the printing of the image in the printing region 50-1 by the cyan (C) ink and the magenta (M) ink. On the other hand, the transparent layer is formed by ejecting the processing liquid in two scannings of the final fifth scanning and the previous fourth scanning. Ejection data for ejecting the processing liquid as described above is generated in the manner as described below.

As describe above, the binarization unit 31 of FIG. 4 binarizes bit maps for the cyan (C) ink and the magenta (M) ink. When the C and M data are data for forming ink dots of cyan (C) and magenta (M) on the printing region 50-1 (see FIG. 15) as shown in FIG. 7, the following image processing is performed to generate the processing liquid ejection data.

Figure 17A:
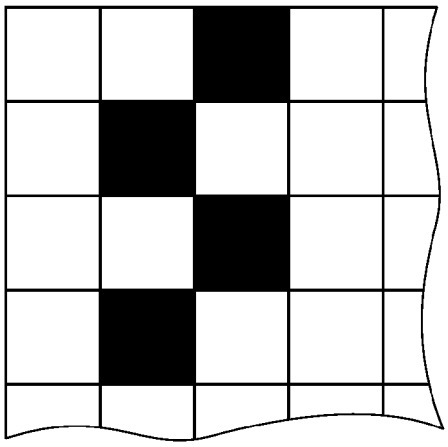
FIG. 17A to FIG. 17D illustrate random mask patterns for ejecting magenta ink.
Figure 17B:
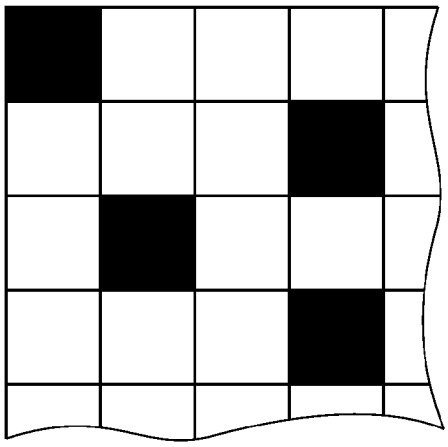
Figure 17C:
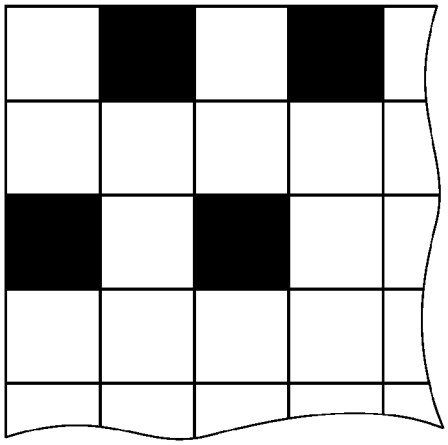
Figure 17D:
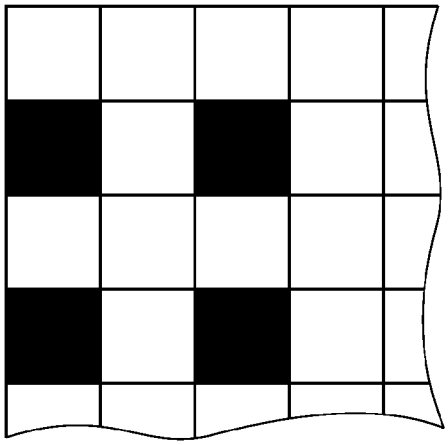
Figure 18:
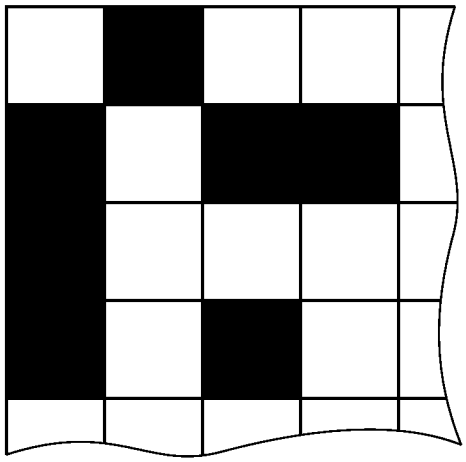
FIG. 18 illustrates a pattern obtained by combining the fourth scanning mask pattern in FIG. 16D and the fourth scanning mask pattern in FIG. 17D.

First, the data C and the data M are divided into pieces of data for the first scanning to the fourth scanning, respectively. The C and M data in the first, second, third, and fourth scannings of the printing region 50-1 corresponds to the regions A, B, C, and D of the printing heads 22C and 22M. As in the above-described embodiment, the data C is divided as shown in FIG. 8A to FIG. 8D and the data M is divided as shown in FIG. 9A to FIG. 9D. The data C is divided by the previously-prepared random mask C of FIG. 16A to FIG. 16D. The data M is divided by the previously-prepared random mask M of FIG. 17A to FIG. 17D. FIG. 18 illustrates the mask pattern corresponding to the sum of the random mask C of the fourth scanning (FIG. 16D) and the random mask M of the fourth scanning (FIG. 17D).

Figure 19A:
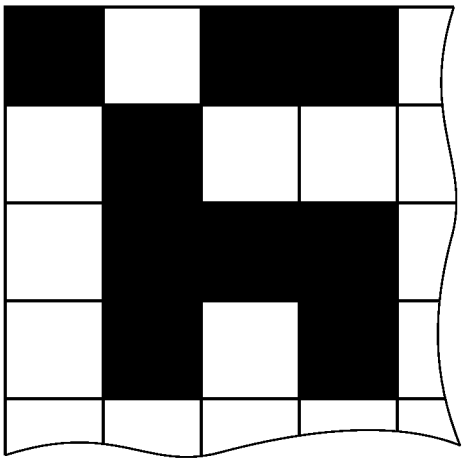
FIG. 19A and FIG. 19B illustrate random mask patterns for ejecting the processing liquid in the fourth scanning and the fifth scanning, respectively.
Figure 19B:
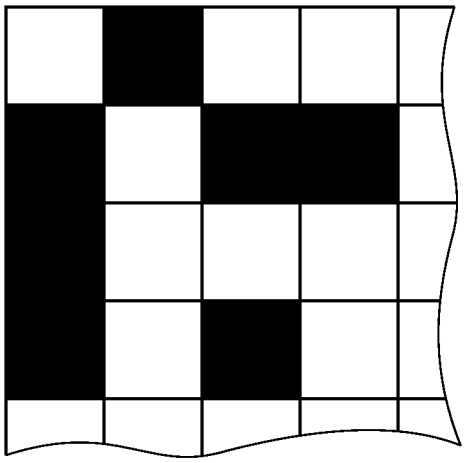

The processing liquid ejection data in the fifth scanning is generated by a mask pattern of FIG. 19B. This mask pattern is the mask pattern of FIG. 18. The reason is that, with regard to a pixel for which the ink is ejected in the fourth scanning, the processing liquid can be ejected only in the fifth scanning. The processing liquid ejection data for the fourth scanning is generated by a mask pattern (mask pattern of FIG. 19A) opposite to the mask pattern of FIG. 18. In other words, an inverse pattern. This mask pattern shows pixels for which ink ejection is to be completed until the third scanning. The processing liquid data corresponding to the mask patterns of FIG. 19A and FIG. 19B is generated by the processing by the processing liquid data generation unit 33.

Next, the logical sum computation processing unit (OR circuit) 34 calculates the logical sum of the pattern of FIG. 6 previously stored in the processing liquid pattern storage unit 35 and the data generated by the processing liquid data generation unit 33 to generate the data of FIGS. 20A to 20E. Specifically, the logical sum of the pattern of FIG. 6 and the processing liquid data corresponding to the mask pattern of FIG. 19A is used to generate the processing liquid ejection data in the fourth scanning as shown in FIG. 20D. The logical sum of the pattern of FIG. 6 and the processing liquid data corresponding to the mask pattern of FIG. 19B is used to generate the processing liquid ejection data in the fifth scanning as shown in FIG. 20E.

As shown in FIG. 15, the processing liquid in the fourth scanning is ejected through the ejection openings of the region d of the printing head 22H. The processing liquid in the fifth scanning is ejected through the ejection openings of the region e of the printing head 22H. In other words, the processing liquid can be ejected in two scannings through the ejection openings of the regions d and e. It is noted that the method for generating the processing liquid ejection data based on the mask pattern for generating the ejection data for the respective ink colors is not limited to the above-described method.

As described above, in this embodiment, based on the mask pattern used for the image formation by the pigment ink for example, the processing liquid is ejected in two scannings—the final scanning and the previous scanning. Thus, the ejection pattern of the processing liquid in these scannings (i.e., the pattern by which dots formed by the processing liquid are arranged) can be previously determined. Consequently, the control for the printing can be easier both in the structure and in time.

In this embodiment, the range of ejection openings of a printing head for ejecting the processing liquid can be increased as in the above-described embodiment, thus providing the nozzle with an improved durability. Furthermore, by allocating the processing liquid ejection data to a plurality of scannings, the drying of dots of the processing liquid on the printing medium and an image can be speeded up to remedy problems in image performance such as the flooded ink phenomenon, and the interference pattern phenomenon.

(Other Embodiments)

In the above-described embodiments, the printing head is structured so that the ejection openings constituting a nozzle for ejecting the pigment ink and the ejection openings constituting a nozzle for ejecting the processing liquid are arranged in the main scanning direction. However, another printing head also can be used that is structured so that the ejection openings for ejecting the pigment ink and the ejection openings for ejecting the processing liquid are arranged in a dislocated manner in a direction crossing the main scanning direction (e.g., the sub-scanning direction). A larger number of n for ejecting the processing liquid also may be provided than the number of nozzles for ejecting the pigment ink and the former nozzles also may be arranged in a nozzle array longer than that in which the latter nozzles are arranged.

In the above-described first embodiment, the timing at which the processing liquid is ejected is divided to the final scanning (the fifth scanning) and the previous plurality of scannings (the first, second, third, and fourth scannings). In the second embodiment, the timing at which the processing liquid is ejected is divided to the final scanning (the fifth scanning) and the previous scanning (the fourth scanning). However, another configuration also can be structured so long as the completion of the formation of an image in a unit area (unit print area) such as each pixel is followed by the ejection, through a plurality of scannings, of the processing liquid to the unit area already subjected to the image formation. Thus, the number of divided timings for ejecting the processing liquid and the method therefor is not limited to the above-described embodiments. For example, the timing also may be divided into the final scanning (the fifth scanning) and the previous first and third scannings. It is not always required to apply the processing liquid to all unit areas after the image formation. With regard to a part of all unit areas, as in the above-described embodiments, the processing liquid mask pattern also can be used to thin out the processing liquid ejection data. With regard to a part of all unit areas, the processing liquid also may be ejected before the completion of the image formation. The reason is that the processing liquid ejected on the printing medium and on the formed image may expand to realize a coverage exceeding a coverage required to improve the image performance.

With regard to a pixel having no pigment ink ejection data (margin pixel), in the first embodiment, the processing liquid is ejected in the first scanning, and in the second embodiment, the processing liquid is ejected in the final scanning (the fifth scanning) and the previous scanning (the fourth scanning). However, with regards to a pixel having no pigment ink ejection data (margin pixel), the processing liquid also may be ejected only in the final scanning. In this case, the same effect is also obtained. Thus, with regards to a pixel having no pigment ink ejection data (margin pixel), the number at which the timing for ejecting the processing liquid is divided and the method thereof is not limited. Furthermore, the ejection of the processing liquid need not be performed for a pixel having no pigment ink ejection data (margin pixel).

In the above-described embodiments, for ejecting the processing liquid after the completion of the image formation by the pigment ink, the processing liquid is ejected after the scanning next to the scanning at which the image formation is completed. However, the processing liquid also may be ejected in the scanning at which the image formation is completed so long as the image formation by the pigment ink is completed. In this case, by using the printing head (FIG. 2) in the above-described embodiment, in which ejection openings for ejecting the processing liquid are arranged in one array, the processing liquid can be ejected in a single scanning in one direction (direction shown by the arrow X1) among two printing directions. When a printing head is used that is structured to have ejection opening arrays for ejecting the processing liquid at both ends of the printing head in printing directions, a different ejection opening array for the processing liquid may be used depending on the printing direction to eject the processing liquid in a single scanning in any direction of two printing directions.

The present invention can be widely applied to various ink jet printing apparatuses in which a printing head that can eject an ink and a processing liquid is scanned over a predetermined area on a printing medium to form an image by the ink on the printing medium and to cover the formed image by the processing liquid. Thus, the configuration of the printing head and the number of printing heads are not limited to the above-described embodiments.

In the present invention, the processing liquid may be ejected in two or more scannings among a plurality of scannings to a predetermined area for which the image formation is completed. Thus, the processing liquid may be ejected in three or more scannings. When an image in a predetermined area is formed by the maximum n scannings of the printing head (n is an integer of two or more), the processing liquid also may be ejected in two or more scannings prior to the nth scanning of the printing head. Alternatively, the processing liquid also maybe ejected in two or more scannings including at least one scanning after the nth scanning of the printing head.

The processing liquid also may be ejected to a predetermined area in which no ink image is formed in at least one scannings among the plurality of scannings of the printing head. For example, the processing liquid can be ejected in the first scanning among a plurality of scannings of the printing head. When the image in a predetermined area is formed by the maximum n scannings of the printing head (n is an integer of two or more), the processing liquid also may be ejected in the first scanning after the nth scanning of the printing head.

The printing head also may eject one type of ink for forming an image or also may eject a plurality of different inks.

In the above-described embodiments, in addition to the pigment ink used for the image formation, the processing liquid for improving the image performance of the pigment ink (abrasion resistance in the above-described embodiments) is used. As described above, the processing liquid is basically used separately from the image formation. Thus, the processing liquid is preferably transparent and colorless. However, among the pigment inks used for image formation such as light cyan ink, light magenta ink, and light gray ink, a part or the entirety of light-color pigment ink also may be added with material for improving a function such as abrasion resistance so that the colored ink can function to achieve both of image formation and an improved function such as abrasion resistance. In this case, a processing liquid tank provided separately from the one for ink or an additional component such as a printing head (which corresponds to a component required by the addition of one color of ink) is not required. Thus, this can contribute a lot to miniaturization and price-reduction of the printing apparatus. Among the pigment inks used for image formation, a part or the entirety of deep-color pigment ink also may function as the processing liquid.

The predetermined area can be set as an area corresponding to a dot formed by the ink on the printing medium or also may be set as various areas. Although the processing liquid desirably includes a resin component for forming a transparent layer on the surface of the printing medium, various processing liquids also can be used.

The present invention can be used for various printing apparatuses using a printing medium such as a paper, cloth, nonwoven cloth, or an OHP film. Specifically, the present invention can be applied to a business machine such as a printer, a copier, or a facsimile.

Figure 24:
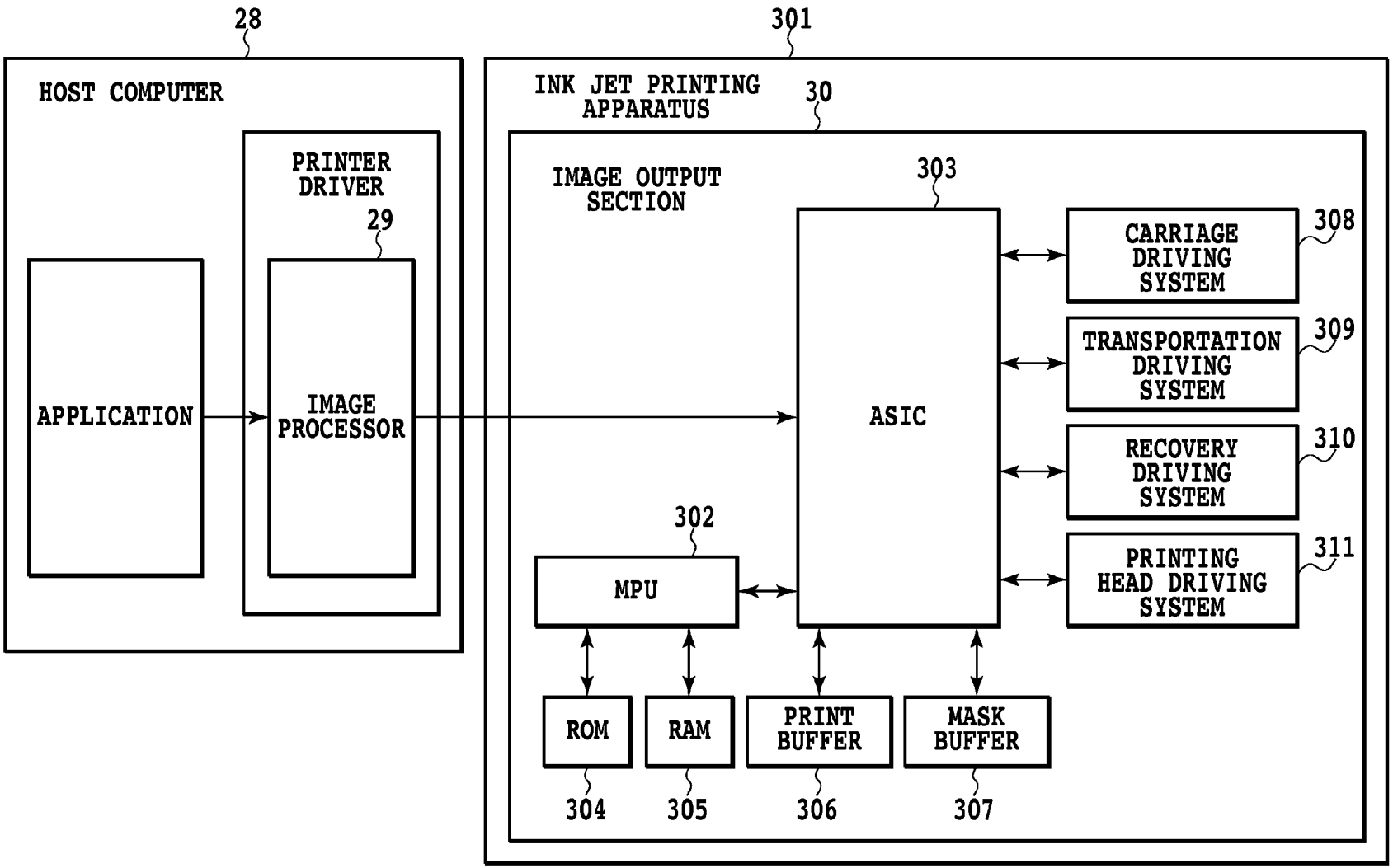
FIG. 24 illustrates a schematic structure of an ink jet printing system that can be applied to the present invention.

Although the above-described embodiments has described a case where the image processor 29 for performing the characteristic processing of the present invention is provided in the ink jet printing apparatus, the image processor 29 is not required to be provided in the ink jet printing apparatus. For example, as shown in FIG. 24, a printer driver of a host computer connected to the ink jet printing apparatus also may have the function of the image processor 29. In this case, the printer driver generates pigment ink ejection data and processing liquid ejection data based on multi-valued image data received from an application to supply the data to the ink jet printing apparatus 301. As described above, the ink jet printing system including the host computer and the ink jet printing apparatus 301 is also included in the scope of the present invention. In this case, the host computer functions as a data supply apparatus that supplies data to the ink jet printing apparatus and also functions as a control apparatus for controlling the ink jet printing apparatus.

The present invention is mainly characterized in the data processing carried out by the image processor 29. Thus, a data generating apparatus including the image processor 29 for carrying out the characteristic data processing of the present invention is also included in the scope of the present invention. In the present invention, when the image processor 29 is included in an ink jet printing apparatus, the ink jet printing apparatus functions as the data generating apparatus. In the present invention, when the image processor 29 is included in a host computer, the host computer functions as the data generating apparatus.

A computer program for enabling a computer to carry out the above-described characteristic data processing and a storage medium storing the program so that the program can be read by the computer are also included in the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-242664, filed Sep. 19, 2007, which is hereby incorporated by reference herein in its entirety.

What is claimed is:

1. A printing apparatus for causing a printing head to perform a plurality of printing scannings over a predetermined area of the printing medium, the print head being capable of ejecting an ink and a processing liquid for covering an image formed by the ink on the printing medium, the printing apparatus comprising:

an obtaining unit configured to obtain an ink ejection data representing an ejection or non-ejection of ink to the predetermined area in each of the plurality of printing scannings;

a detection unit configured to detect an order of a final scanning at which the ink is finally ejected to the predetermined area based on the ink ejection data obtained by the obtaining unit; and a determining unit configured to determine an order of scanning at which the processing liquid is ejected among the plurality of printing scannings on the predetermined area, based on the order of the final scanning in the plurality of printing scannings detected by the detecting unit.

2. The printing apparatus according to claim 1, wherein the determining unit determines the order of scanning such that the processing liquid is ejected in a scanning after the final scanning.

3. The printing apparatus according to claim 1, wherein the printing head is adapted to eject a plurality of different color inks.

4. The printing apparatus according to claim 1, wherein the processing liquid forms a transparent layer on the image formed by the ink.

5. The printing apparatus according to claim 1, wherein the obtaining unit obtains the ink ejection data for each of a plurality of the predetermined areas, the detection unit detects the order of the final scanning in each of the plurality of predetermined areas, and the determining unit determines, based on the order of the final scanning in each of the plurality of predetermined areas, the order of the scanning at which the processing liquid is ejected among the plurality of printing scannings in each of the plurality of predetermined areas.

6. The printing apparatus according to claim 1, wherein the determining unit determines the order of scanning at which the processing liquid is ejected first among the plurality of printing scannings on the predetermined area.

7. The printing apparatus according to claim 1, wherein the determining unit determines the order of scanning at which the processing liquid is ejected such that the processing liquid is ejected in two or more scannings.

8. A printing method for causing a printing head to perform a plurality of printing scannings over a predetermined area of the printing medium, the print head being capable of ejecting an ink and a processing liquid for covering an image formed by the ink on the printing medium, the printing method comprising the steps of:

obtaining an ink ejection data representing an ejection or non-ejection of ink to the predetermined area in each of the plurality of printing scannings;

detecting an order of a final scanning at which the ink is finally ejected to the predetermined area based on the ink ejection data obtained in the obtaining step; and determining an order of scanning at which the processing liquid is ejected among the plurality of printing scannings on the predetermined area, based on the order of the final scanning in the plurality of printing scannings detected by the detecting unit.

9. The printing method according to claim 8, wherein the determining step determines the order of scanning such that the processing liquid is ejected in a scanning after the final scanning.

10. The printing method according to claim 8, wherein the printing head is adapted to eject a plurality of different color inks.

11. The printing method according to claim 8, wherein the processing liquid forms a transparent layer on the image formed by the ink.

12. The printing method according to claim 8, wherein the obtaining step obtains the ink ejection data for each of a plurality of the predetermined areas, the detecting step detects the order of the final scanning in each of the plurality of predetermined areas, and the determining step determines, based on the order of the final scanning in each of the plurality of predetermined areas, the order of the scanning at which the processing liquid is ejected among the plurality of printing scannings in each of the plurality of predetermined areas.

13. The printing method according to claim 8, wherein the determining step determines the order of scanning at which the processing liquid is ejected first among the plurality of printing scannings on the predetermined area.

14. The printing method according to claim 8, wherein the determining step determines the order of scanning at which the processing liquid is ejected, such that the processing liquid is ejected in two or more scannings.

* * * * *